US007087873B2

(12) United States Patent
Hayakawa et al.

(10) Patent No.: US 7,087,873 B2
(45) Date of Patent: Aug. 8, 2006

(54) HIGH FREQUENCY HEATING APPARATUS WITH STEAM GENERATING FUNCTION

(75) Inventors: Yuji Hayakawa, Shiki-gun (JP); Kouji Kanzaki, Yamatokoriyama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 99 days.

(21) Appl. No.: 10/496,452

(22) PCT Filed: Dec. 27, 2002

(86) PCT No.: PCT/JP02/13843

§ 371 (c)(1),
(2), (4) Date: May 21, 2004

(87) PCT Pub. No.: WO03/077604

PCT Pub. Date: Sep. 18, 2003

(65) Prior Publication Data

US 2005/0006382 A1 Jan. 13, 2005

(30) Foreign Application Priority Data

Mar. 12, 2002 (JP) ..... 2002-067034
Jul. 25, 2002 (JP) ..... 2002-216875

(51) Int. Cl.
*H05B 6/80* (2006.01)
*H05B 6/74* (2006.01)

(52) U.S. Cl. ..... 219/682; 219/751; 219/757; 219/401; 126/21 A; 99/451

(58) Field of Classification Search ..... 219/681–685, 219/710–711, 757, 400, 401, 751; 126/21 A; 99/451, 474

See application file for complete search history.

(56) References Cited

U.S. PATENT DOCUMENTS 5,767,487 A * 6/1998 Tippmann ..... 219/682
5,945,021 A 8/1999 Chung

FOREIGN PATENT DOCUMENTS

JP 53-78655 6/1978

(Continued)

OTHER PUBLICATIONS

Patent Abstracts of Japan, vol. 018, No. 644 (M-1718), Dec. 7, 1994 & JP 06 249445 A (Sanyo Electric Co., Ltd.), Sep. 6, 1994.

*Primary Examiner*—Philip H. Leung
(74) *Attorney, Agent, or Firm*—Pearne & Gordon LLP

(57) ABSTRACT

A high-frequency heating apparatus with a steam generating function, which heat-treats a to-be-heated object by supplying at least high-frequency waves or steam to a heating chamber 11 that accommodates the object. This high-frequency heating apparatus has a high frequency wave generating portion 13, a steam generating portion 15 for generating steam in the heating chamber 11, and a circulating fan 17 for agitating air in the heating chamber 11. Moreover, the high-frequency heating apparatus has a chamber air heater 19 for heating air circulating in the heating chamber 11. The steam generating portion 15 generates steam by heating an evaporating dish 35 that has a water storing recess.

25 Claims, 28 Drawing Sheets

FOREIGN PATENT DOCUMENTS

| | | |
|---|---|---|
| JP | 54-115448 | 9/1979 |
| JP | 54-127769 | 10/1979 |
| JP | 8-135978 | 5/1996 |
| JP | 8-135981 | 5/1996 |
| JP | 8-178298 | 7/1996 |
| JP | 9-4849 | 1/1997 |
| JP | 2001-355844 | * 12/2001 |

* cited by examiner

HIGH FREQUENCY HEATING APPARATUS WITH STEAM GENERATING FUNCTION

TECHNICAL FIELD

The present invention relates to a high-frequency heating apparatus with a steam generating function, which is adapted to heat-treat an object by combining high-frequency heating and stream-heating.

BACKGROUND ART

Conventional high-frequency heating apparatuses are a microwave oven having a high-frequency generator for heating, and a combination oven to which a convection heater for generating hot air in this microwave oven is added. Further, a steamer for heating an object by introducing steam into a heating chamber, and a steam convection oven, in which a convection heater is added to a steamer, are utilized as cooking apparatuses.

When food is cooked by the cooking apparatus, the cooking apparatus is controlled to make the finished state of the food the best condition. That is, cooking performed by combining a high-frequency heating technique with a hot-air heating technique, and cooking performed by combining a steam heating technique with a hot-air heating technique are controlled by the steam convection oven. However, the cooking performed by combining the high-frequency heating technique and the steam heating technique troubles a user to transfer the heated food between separate cooking apparatus each used for heat-treating according to a corresponding one of these techniques. There has been developed a cooking apparatus enabled to achieve by itself high-frequency heating, steam heating, and electric heating so as to resolve such inconvenience. This conventional cooking apparatus is disclosed in, for example, JP-A-54-115448.

However, according to the configuration of the conventional cooking apparatus disclosed in JP-A-54-115448, a vaporizing chamber for generating heating steam is embedded in a lower portion of the heating chamber, and adapted to be always supplied with water from a water storage tank maintained at a constant water level. Therefore, it is difficult to perform a daily work of cleaning around the heating chamber. Especially, in the vaporizing chamber, during the process of generating steam, calcium and magnesium contained in water content are condensed, deposited and fixed onto the bottom portion of the vaporizing chamber and in a pipe to thereby reduce an amount of generated steam. Consequently, the conventional cooking apparatus has a problem that the environment of the heating chamber is so unsanitary that the propagation of fungus easily occurs.

Further, although a method of generating steam by using a heating means, such as a boiler, disposed outside the heating chamber and supplying the steam generated therein to the heating chamber is considered as a way of introducing steam into the heating chamber, troubles, such as propagation of saprophytes, breakage due to freeze-up, and contamination by foreign material owing to rust, occur in a pipe for introducing steam. Moreover, the heating means are usually difficult to disassemble and clean. Therefore, it is difficult for a cooking apparatus, which treats food and needs a lot of attention thereto, to employ the method of externally introducing steam.

Furthermore, although it is usual that a temperature sensor, such as an infrared ray sensor, for measuring the temperature of an object to be heated is provided in a cooking apparatus, the infrared ray sensor measures the temperature of suspended steam particles, which are present between the sensor and the object, instead of the temperature of the object. Thus, the temperature of the object cannot be measured. Then, a heating control adapted to operate according to a result of detection of the temperature, which is performed by the infrared ray sensor, does not normally operate. Consequently, troubles, for instance, under heating or overheating occur. Especially, in the case of following a sequential procedure for performing automatic cooking, even when under heating occurs, control advances to the next step without compensation. Thus, the conventional cooking apparatus cannot deal with the underheating problem by simply performing reheating or radiational cooling. Consequently, the cooking may results in failure.

Further, the conventional cooking apparatus has another problem that this apparatus cannot necessarily heat the object by using a heating pattern, which has high heating efficiency, according to the kind of the object and to the temperature conditions thereof in the case where the object is a frozen food or a chilled food, and that thus, along heating time is necessary.

DISCLOSURE OF INVENTION

The invention is accomplished in view of the aforementioned circumstances. Accordingly, an object of the invention is to provide a high-frequency heating apparatus with a steam generating function, which is enabled to easily clean a steam generating portion, to always maintain the steam generating portion in a sanitary condition, to perform proper heating treatment by accurately measuring the temperature of a to-be-heated object, and to enhance the heating efficiency thereof.

To achieve the foregoing object, according to an aspect of the invention, there is provided a high-frequency heating apparatus with a steam generating function, which heat-treats an object by supplying at least high-frequency waves or steam to a heating chamber that accommodates the object. This high-frequency heating apparatus comprises a high frequency wave generating portion, a steam generating portion for generating steam in the heating chamber, and a circulating fan for agitating air in the heating chamber.

This high-frequency heating apparatus with a steam generating function according to the invention is adapted to generate steam in the heating chamber. Thus, steam can be quickly supplied into the heating chamber. Thus, the efficiency in generating steam can be enhanced. Further, because the steam generating portion is present in the heating chamber, the cleaning of the steam generating portion can be easily performed concurrently with the cleaning of the inside of the heating chamber. Thus, the internal environment of the heating chamber can be always maintained in a sanitary condition. Furthermore, because air of the heating chamber is circulated and agitated by the circulating fan, steam can be uniformly circulated all around the heating chamber, especially, when the steam heating is performed. Thus, the heating efficiency in heating the object can be enhanced. Moreover, steam can be circulated all over the entire heating chamber without being retained. Consequently, the accuracy of measurement of the temperature of the object, which is performed by, for instance, the infrared ray sensor, can be improved. Thus, proper heating treatment can be performed. Further, both the high frequency heating and the steam heating can be concurrently performed as the heating method. Alternatively, one of the high frequency heating and the steam heating can be individually performed. Alternatively, both the high frequency heating and the steam heating can be performed in a predetermined order. These ways of performing the heating method can be freely chosen and performed. Thus, an appropriate cooking method can be selected according to the kind of food, and to which of a frozen food and a chilled food the object is. Especially, in the case of employing both the high frequency heating and the steam heating, the rate of rise of temperature can be increased. Thus, quick and efficient cooking is enabled.

According to the second aspect of the invention, the high-frequency heating apparatus with a steam generating function further comprises a chamber air heater for heating air that circulates in the heating chamber.

The second high-frequency heating apparatus of the invention with a steam generating function is adapted so that air circulating in the heating chamber is heated by the chamber air heater. Thus, the temperature of steam can be freely raised. Efficient rise of the temperature of the object is realized owing to the overheated steam by raising the temperature of the steam. Moreover, the rise of the temperature of the steam enables the high-temperature steam to brown the object. Furthermore, when the object is a frozen food, the defrosting of the object can be more efficiently performed.

According to the third aspect of the invention, in the high-frequency heating apparatus with a steam generating function, the steam generating portion has an evaporating dish that is provided in the heating chamber and that has a water storing recess adapted generate steam by being heated.

The third high-frequency heating apparatus with a steam generating function according to the invention is adapted so that the evaporating dish is disposed in the heating chamber, and that steam is generated by heating water stored in the water storing recess of the evaporating dish. Thus, the cleaning of a part generating steam can be easily performed simultaneously with the cleaning of the inside of the heating chamber. That is, this means that the internal environment of the heating chamber can be always maintained in a sanitary condition because of the fact that although calcium and magnesium contained in water content are sometimes condensed in the process of generating steam and deposited and fixed onto the bottom portion of the evaporating dish, the cleaning of such apart can be easily completed only by removing substances having adhered to the surface of the evaporating dish.

According to fourth aspect of the invention, a high-frequency heating apparatus with a steam generating function, which heat-treats an object by supplying at least high-frequency waves or steam to a heating chamber that accommodates the object. The fourth high-frequency heating apparatus comprises a high frequency wave generating portion, and a steam generating portion, which is provided in the heating chamber, for generating steam from an evaporating dish that has a water storing recess adapted to generate steam by being heated.

The fourth high-frequency heating apparatus with a steam generating function is adapted so that steam is generated from the evaporating dish that is provided in the heating chamber. Thus, the steam is directly supplied into the heating chamber. Moreover, the cleaning of the steam generating portion can be easily performed. Consequently, the environment around the heating chamber can be always maintained in a sanitary condition. Furthermore, a heating method obtained by combining the high frequency heating technique with the steam heating technique can be easily realized.

According to the fifth aspect of the invention, the high-frequency heating apparatus with a steam generating function, the evaporating dish is disposed on a back-side bottom face, which is on the opposite side of an object outlet of the heating chamber, from which the object is taken out.

The fifth high-frequency heating apparatus with a steam generating function according to the invention is adapted so that the evaporating dish is disposed on the back-side bottom face, which is on the opposite side of the object outlet of the heating chamber. Thus, the evaporating dish is not an obstacle to the taking-out of the object. Further, even when the evaporating dish is at a high temperature, there is no fear that a user's hand touches the evaporating dish when the user takes the object into and out of the heating apparatus. Consequently, the safety of the heating apparatus can be improved.

According to the sixth aspect of the invention, the high-frequency heating apparatus with a steam generating function according to the invention, the evaporating dish is disposed on the bottom face along one of side wall surfaces of the heating chamber.

In the case of the sixth high-frequency heating apparatus with a steam generating function according to the invention, steam can be efficiently supplied from the evaporating dish to the inside of the heating apparatus by disposing the evaporating dish on the bottom face along one of side wall surfaces of the heating chamber.

According to seventh aspect of the invention, the high-frequency heating apparatuses with a steam generating function according to the invention, the evaporating dish is disposed at a place at which the top face of the evaporating dish is at a predetermined height above the bottom face of the heating chamber.

The seventh high-frequency heating apparatus with a steam generating function can prevent liquid, such as juice oozed from the object to the bottom face of the heating chamber, from flowing into the evaporating dish through the bottom face of the heating chamber. Thus, the evaporating dish can be maintained in a sanitary condition.

According to the eighth aspect of the invention, the high-frequency heating apparatuses with a steam generating function further comprises an infrared ray sensor for measuring the temperature in the heating chamber. In the eighth high-frequency heating apparatus, the evaporating dish is disposed at a place that is substantially outside a temperature measurement range in which the sensor measures the temperature.

The eighth high-frequency heating apparatus with a steam generating function can measure the temperature in the heating chamber with good accuracy by using the infrared ray sensor without erroneously detecting the high-temperature evaporating dish.

According to ninth aspect of the invention, the high-frequency heating apparatuses with a steam generating function, the evaporating dish is disposed in such a manner as to be able to be detached from the heating chamber.

In the case of the ninth high-frequency heating apparatus with a steam generating function according to the invention, the evaporating dish is disposed in such a manner as to be able to be detached from the heating chamber. Thus, the evaporating dish can be cleaned by being taken out of the heating chamber. This facilitates the cleaning of the evaporating dish. Moreover, the replacement of the evaporating dish can be easily performed. Consequently, the use of evaporating dishes of different sizes is enabled.

According to the tenth aspect of the invention, the high-frequency heating apparatuses with a steam generating function, the evaporating dish has tapered portions respectively provided at both end portions thereof so that the water storing recess gradually becomes shallower along a longitudinal direction thereof in each of the tapered portions.

In the case of the tenth high-frequency heating apparatus with a steam generating function according to the invention, water injected into the water storing recess is always stored in the central part of the evaporating dish.

According to the eleventh aspect of the invention, the high-frequency heating apparatuses with a steam generating function, the evaporating dish has a cover, which covers the top face of the evaporating dish and which has at least one aperture that opens a part of the top face thereof.

In the case of the eleventh high-frequency heating apparatus uses with a steam generating function according to the invention, the top surface of the evaporating dish for generating steam is covered with the cover. Thus, an amount of generated steam can be controlled by the area of the aperture provided in the cover.

According to the twelfth aspect of the invention, the high-frequency heating apparatus with a steam generating function, the cover is disposed in such a manner as to be able to be detached from the evaporating dish.

In the case of the twelfth high-frequency heating apparatus with a steam generating function according to the invention, the cover is disposed in such a manner as to be able to be detached from the evaporating dish, so that the cover can be cleaned by being taken out of the heating chamber, and that the cleaning of the evaporating dish is facilitated. Moreover, the replacement of the cover with another cover provided with an aperture of a different size is facilitated. Consequently, a cover suitable for use in the heating conditions can be used.

According to the thirteenth aspect of the invention, the high-frequency heating apparatus with a steam generating function, a leg portion for forming a gap having a predetermined height the evaporating dish therefrom is provided on the bottom surface of the cover.

In the case of the thirteenth high-frequency heating apparatus with a steam generating function according to the invention, a gap having a predetermined spacing is formed between the cover and the evaporating dish by the leg portion of the cover. Thus, when the water stored in the evaporating dish is heated, an increase in the pressure in the lower portion of the cover can be restrained by this gap. Thus, even when the temperature of the water stored in the evaporating dish rises and a bumping occurs, air causing pressure at that time is efficiently let out from the gap. This prevents water from scattering from the aperture.

According to the fourteenth aspect of the invention, the high-frequency heating apparatuses with a steam generating function, a plurality of the apertures are provided in such a way as to extend along the longitudinal direction of the cover.

In the case of the fourteenth high-frequency heating apparatus with a steam generating function, steam is uniformly supplied from the plurality of the apertures into the heating chamber.

According to the fifteenth aspect of the invention, the high-frequency heating apparatuses with a steam generating function according to the invention, the cover is made of a low-dielectric-constant material.

In the case of the fifteenth high-frequency heating apparatus with a steam generating function according to the invention, the cover is made of a low-dielectric-constant material, so that a wave loss can be suppressed to a low level.

According to the sixteenth aspect of the invention, the high-frequency heating apparatuses with a steam generating function, the steam generating portion has an evaporating dish heater for heating the evaporating dish.

The sixteenth high-frequency heating apparatus with a steam generating function according to the invention is adapted so that steam is generated by heating the evaporating dish by using the evaporating dish heater. Thus, the apparatus can efficiently generates steam by using the evaporating dish heater.

According to the seventeenth aspect of the invention, the high-frequency heating apparatus with a steam generating function, the steam generating portion has a reflector for reflecting radiation heat, which is radiated from the evaporating dish heater, to the evaporating dish.

The seventeenth high-frequency heating apparatus of the invention with a steam generating function according to the invention is adapted so that the radiation heat radiated from the evaporating dish heater is reflected to the evaporating dish by the reflector. Thus, heat generated by the heater can be highly efficiently utilized for generating steam.

According to the eighteenth aspect of the invention, the high-frequency heating apparatuses with a steam generating function further comprises an electromagnetic wave stirring portion for stirring high frequency waves sent from the high frequency wave generating portion and for supplying the high frequency waves to the evaporating dish.

The eighteenth high-frequency heating apparatus with a steam generating function according to the invention is adapted so that the water stored in the evaporating dish is heated and evaporated by using the high frequency waves outputted from the high frequency wave generating portion. Thus, there is no necessity for providing a heater for generating steam. Consequently, the configuration of the apparatus can be simplified, and the cost thereof can be reduced.

According to the nineteenth aspect of the invention, the high-frequency heating apparatuses with a steam generating function further comprises a water supply portion for supplying water to the steam generating portion.

The nineteenth high-frequency heating apparatus with a steam generating function according to the invention is adapted so that water can be supplied to the evaporating dish by the water supply portion. Thus, regardless of the water storing capacity of the evaporating dish, a large amount of steam can be continuously generated for a long stretch of time. Consequently, a long-term cooking to be performed by utilizing the steam heating is enabled.

According to the twentieth aspect of the invention, the high-frequency heating apparatus with a steam generating function, the water supply portion comprises a water storage tank and a water conveyance pump for supplying a predetermined water to the evaporating dish through a water supply conduit.

In the case of the high-frequency heating apparatus with a steam generating function according to the invention, the water supply portion is constructed by comprising the water storage tank and the water conveyance pump. Thus, a necessary amount of water can be stably supplied by the waver conveyance pump from the water storage tank to the evaporating dish.

According to the twenty-first aspect of the invention, the high-frequency heating apparatus with a steam generating function, the water supply portion has a nozzle, detachably provided at a water supply conduit end portion disposed on a wall surface of the heating chamber, for supplying water to the evaporating dish.

In the case of the twenty-first high-frequency heating apparatus with a steam generating function according to the invention, the nozzle is detachably provided there at. Thus, even in the case that the nozzle is smeared when calcium and magnesium contained in water content are fixed there onto, and when the juice scattered from the object adheres thereto, the nozzle can be cleaned by being removed therefrom, similarly as the evaporating dish. Moreover, the smeared nozzle can be replaced with new one. Consequently, the maintenance of the nozzle is facilitated. Thus, the provision of the nozzle at the water supply conduit end portion, so that the cleaning of the nozzle is facilitated, and that water can be supplied to the evaporating dish at all times in a sanitary condition.

According to the twenty-second aspect of the invention, the high-frequency heating apparatus with a steam generating function, the nozzle is formed from a heat resistance resin material.

In the case of the twenty-second high-frequency heating apparatus with a steam generating function according to the invention, the nozzle is formed from the heat resistance resin material. Thus, even when the nozzle touches a food vessel in the heating chamber, the nozzle is not damaged because of the flexibility thereof. Moreover, the cleaning of the inside of the nozzle is facilitated. Furthermore, when the nozzle is manufactured as an injection mold product formed integrally with the heating chamber, the nozzles can be inexpensively supplied by mass production.

According to the twenty-third aspect of the invention, the high-frequency heating apparatus with a steam generating function, the heating chamber is partitioned from circulating fan chamber, in which the circulating fan is disposed, through a partition plate. Further, at least one ventilation hole for enabling the heating chamber and the circulating fan chamber to communicate with each other is formed in the partition plate.

In the case of the twenty-third high-frequency heating apparatus with a steam generating function according to the invention, the circulating fan is accommodated in the circulating fan chamber independently provided outside the heating chamber through the partition wall. Thus, the juice, which may scatter during the cooking of the object, can be prevented from adhering to the circulating fan. Moreover, because ventilation is performed by letting air through the ventilation holes provided in the partition plate, a flow circulating through the circulating fan chamber and the heating chamber can be generated. Moreover, a steam flow generated in the heating chamber can be simplified and changed according to places, at which the ventilation holes are provided, and to the size of each of the ventilation holes.

According to the twenty-fourth aspect of the invention, the high-frequency heating apparatuses with a steam generating function, the heating chamber is partitioned from circulating fan chamber, in which the circulating fan is disposed, through a partition plate. Moreover, a ventilation hole for enabling the heating chamber and the circulating fan chamber to communicate with each other is formed in the partition plate. Furthermore, the aperture is disposed under a ventilation hole for in taking air from the heating chamber to the circulating fan chamber, among the ventilation holes formed in the partition plate.

In the case of the twenty-fourth high-frequency heating apparatus with a steam generating function according to the invention, the top face of the evaporating dish is covered with the cover having the aperture. Thus, steam can be made to blow into the heating chamber only from this aperture. Therefore, the position of a steam outlet can be limited to a given place. Further, steam blowing out of the aperture can be once drawn into the circulating fan chamber by the circulating fan, and then blasted from a blast ventilation hole into the heating chamber by setting the position of the aperture at a place located under one ventilation hole for in taking air from the heating chamber to the circulating fan chamber, among the ventilation holes formed in the partition plate. Hence, the generated steam can be efficiently circulated in the heating chamber.

According to the twenty-fifth aspect of the invention, the high-frequency heating apparatus with a steam generating function, a ventilation hole for blasting air from the circulating fan to the heating chamber is provided at least in a lower half portion of the partition plate. Further, air in the heating chamber is circulated upwardly by the circulating fan.

The twenty-fifth high-frequency heating apparatus with a steam generating function according to the invention is adapted so that air in the heating chamber is upwardly circulated by the circulating fan. Thus, steam, which is going to upwardly rise, is blown against the object from below. Consequently, the object can be efficiently heated.

According to the twenty-sixth aspect of the invention, the high-frequency heating apparatuses with a steam generating function, a self-cooled fan chamber partitioned from the heating chamber and the circulating fan chamber is provided in addition thereto. Further, an infrared ray sensor for detecting a temperature in the heating chamber through a detection hole provided in the wall surface of the heating chamber, and a self-cooled fan, concentrically provided with a drive shaft of the circulating fan, for cooling a drive motor are accommodated in the self-cooled fan chamber. Moreover, a pressure in a self-cooled fan chamber in the vicinity of the detection hole is maintained by rotation of the self-cooled fan at a value that is higher than a value of a pressure in a heating chamber.

The twenty-sixth high-frequency heating apparatus with a steam generating function according to the invention is adapted so that the pressure in the self-cooled fan chamber in the vicinity of the detection hole is maintained by rotation of the self-cooled fan at a value that is higher than a value of the pressure in the heating chamber. Thus, air in the heating chamber can be prevented from entering the self-cooled fan chamber that accommodates the infrared ray sensor. Therefore, detection accuracy can be prevented from being degraded owing to adhesion of stain caused by the heating by the infrared ray sensor.

According to the twenty-seventh aspect of the invention, the high-frequency heating apparatuses with a steam generating function, a supply opening for blowing outside-air to an inner surface of a translucent window of an opening/closing door is provided in a side wall in the vicinity of the opening/closing door of the heating chamber.

The twenty-seventh high-frequency heating apparatus with a steam generating function according to the invention is adapted so that outside-air is blown against the inner surface of the translucent window of the opening/closing door. Thus, fog on the translucent window, which is caused owing to the steam in the heating chamber, can be cleared. Consequently, the external visibility of the inside of the heating chamber can be enhanced. Further, the internal temperature of the heating chamber can be lowered by introducing outside-air thereinto. Thus, the steam in the heating chamber can be restrained from swiftly blowing out therefrom when the opening/closing door.

According to the twenty-eighth aspect of the invention, the high-frequency heating apparatus with a steam generating function, the supply opening is provided in an upper part of one of side wall faces of the heating chamber. Further, an exhaust outlet for exhausting air of the heating chamber is provided in a lower part of the other side wall surface of the heating chamber.

In the case of the twenty-eighth high-frequency heating apparatus with a steam generating function according to the invention, the supply opening is provided in an upper part of one of side wall faces of the heating chamber, while an exhaust outlet for exhausting air of the heating chamber is provided in a lower part of the other side wall surface of the heating chamber. Thus, air flows in such a manner as to obliquely pass over a central space of the heating chamber. Consequently, odorivectors generated from the object, which is being cooked, can be efficiently and gushingly exhausted to the outside.

BRIEF DESCRIPTION OF DRAWINGS

FIG. 15A illustrates a state of this high-frequency heating apparatus, in which the cover is not put thereon yet; and FIG. 15B illustrates another state thereof, in which the cover is put thereon.

BEST MODE FOR CARRYING OUT THE INVENTION

Hereinafter, preferred embodiments of a high-frequency heating apparatus with a steam generating function according to the invention are described in detail with reference to the accompanying drawings.

FIRST EMBODIMENT

Figure 1:
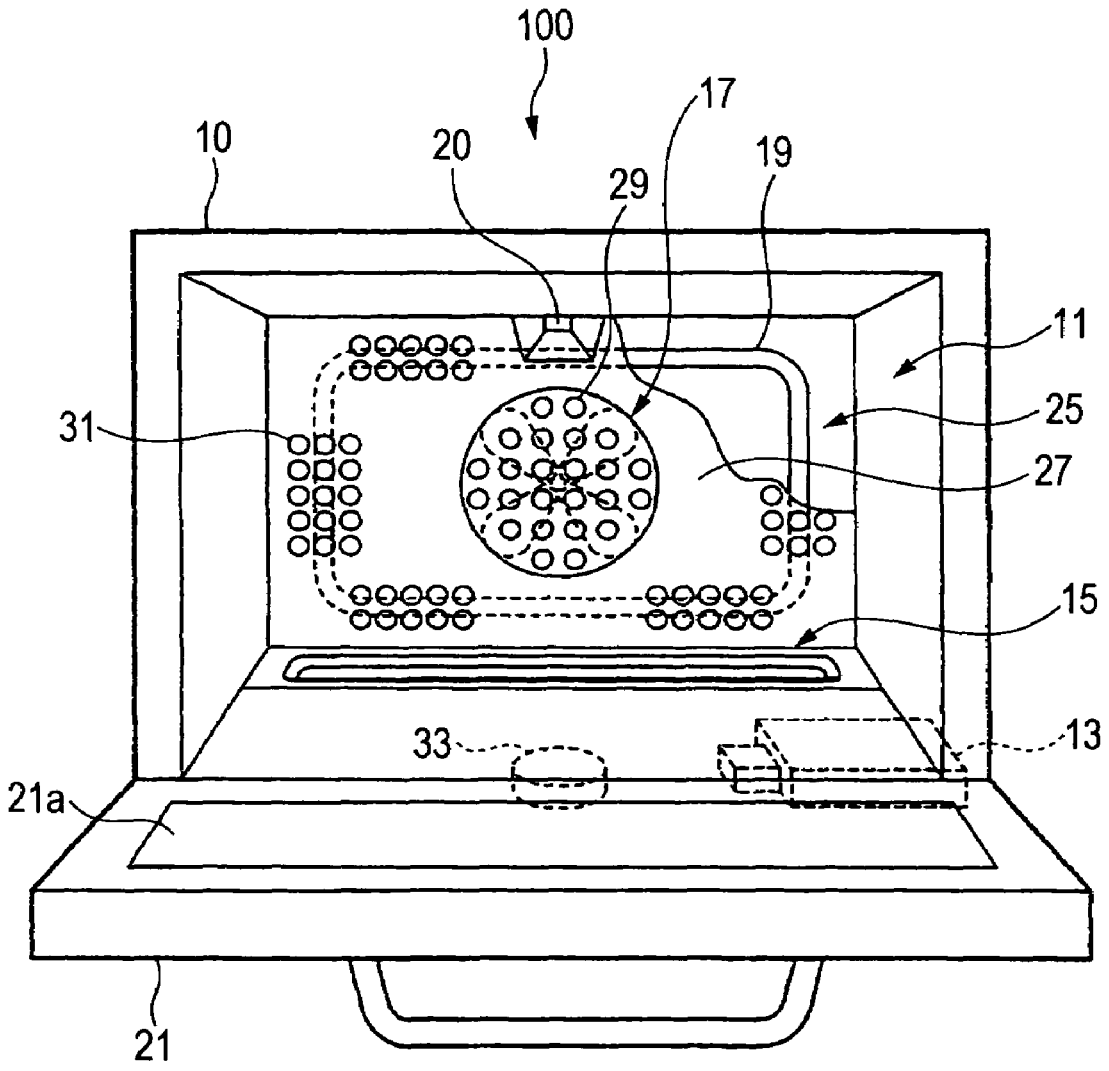
FIG. 1 is a front view illustrating a state of a high-frequency heating apparatus with a steam generating function, which is a first embodiment of the invention and put into a state in which a door thereof is opened.
Figure 2:
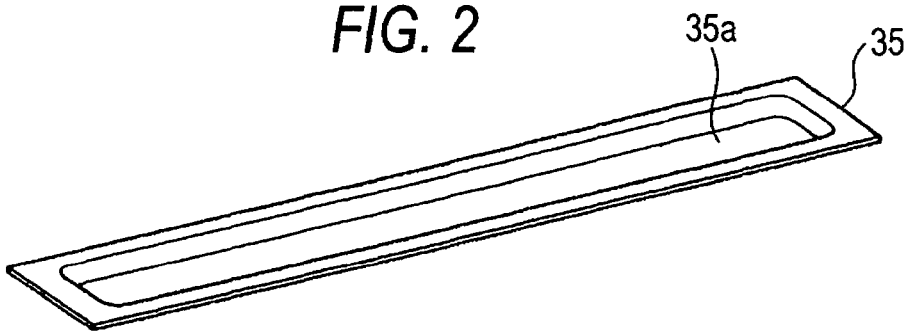
FIG. 2 is a perspective view illustrating an evaporating dish of a steam generating portion for use in the high-frequency heating apparatus with a steam generating function shown in FIG. 1.
Figure 3:
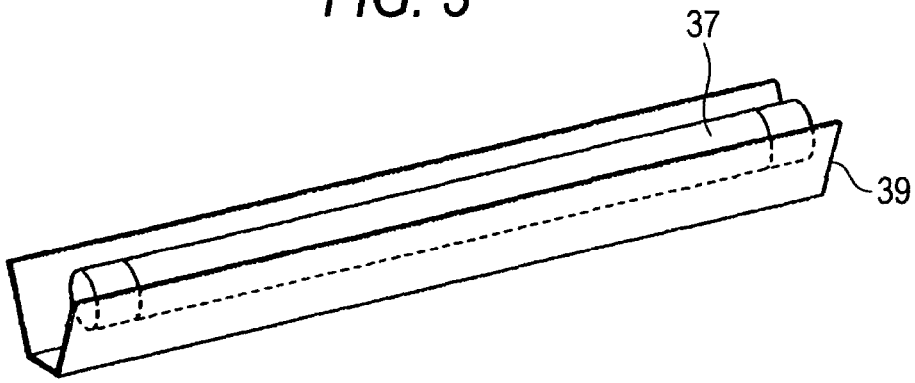
FIG. 3 is a perspective view illustrating an evaporating-dish heater and a reflector of the steam generating portion.
Figure 4:
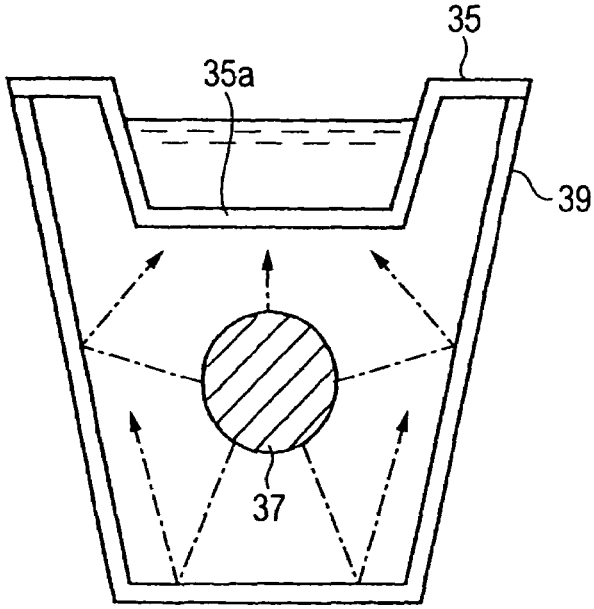
FIG. 4 is a sectional view illustrating the steam generating portion of the apparatus.

FIG. 1 is a front view illustrating a state of a high-frequency heating apparatus with a steam generating function, which is a first embodiment of the invention and put into a state in which a door thereof is opened. FIG. 2 is a perspective view illustrating an evaporating dish of a steam generating portion for use in this apparatus. FIG. 3 is a perspective view illustrating an evaporating-dish heater and a reflector of the steam generating portion. FIG. 4 is a sectional view illustrating the steam generating portion.

This high-frequency heating apparatus with a steam generating function 100 is a cooking apparatus adapted to heat-treat a to-be-heated object by supplying at least high-frequency waves (microwaves) or steam to a heating chamber 11 that accommodates the object. The high-frequency heating apparatus 100 comprises a magnetron 13 serving as a high-frequency wave generating portion for generating high-frequency waves, a steam generating portion 15 for generating steam in the heating chamber 11, a circulating fan 17 for agitating and circulating air in the heating chamber 11, a convection heater 19 serving as a chamber air heater for heating air that circulates in the heating chamber 11, and an infrared ray sensor 20 for detecting the internal temperature of the heating chamber 11 through a detection hole provided in the heating chamber 11.

The heating chamber 11 is formed in a front-open box body case 10. An opening/closing door 21 with a translucent window 21*a* for opening and closing an object outlet of the heating chamber 11 is provided in a front face portion of the body case 10. The bottom end of the opening/closing door 21 is hinge-connected to a bottom edge of the body case 10, so that the door 21 is enabled to be downwardly opened and upwardly closed. A predetermined heat insulating space is secured between the wall surfaces of the heating chamber 11 and the body case 10. A heat insulating material is charged into the space, if necessary. Especially, the rear space of the heating chamber 11 is a circulating fan chamber 25 that accommodates the circulating fan 17 and the drive motor 23 (see FIG. 7). The rear wall of the heating chamber 11 is a partition plate 27 for partitioning the heating chamber 11 from the circulating fan chamber 25. Intake ventilation holes 29 each for in taking air from heating chamber 11 to the circulating fan chamber 25, and blast ventilation holes 31 each for blasting air to the heating chamber 11 from the circulating fan chamber 25 are provided in the partition plate 27 by differentiating a formation area, in which the intake ventilation holes 29 are formed, from a formation area, in which the blast ventilation holes 31 are formed. The ventilation holes 29 and 31 are formed as punched holes.

The circulating fan 17 is disposed in such a way as to place the center of rotation thereof at the central part of the rectangle partition plate 27. A rectangular-ring-like convention heater 19 is provided in the circulating fan chamber 25 in such a manner as to surround this circulating fan 17. Further, the intake ventilation holes 29 formed in the partition plate 27 are disposed in front of the circulating fan 17. The blast ventilation holes 31 are disposed along the rectangular-ring-like convection heater 19. The apparatus is set so that when the circulating fan 17 is rotated, wind flows from the front side of the circulating fan 17 to the rear side thereof, at which a drive motor 23 is provided. Thus, air in the heating chamber 11 is drawn into the central portion of the circulating fan 17 through the intake ventilation holes 29. Then, the air passes through the convection heater 19 provided in the circulating fan chamber 25. Finally, the air is blasted from the blast ventilation holes 31 into the heating chamber 11. Thus, during agitated, air in the heating chamber 11 is circulated through the circulating fan chamber 25 by following this flow process.

The magnetron 13 is disposed in the space that is provided under, for example, the heating chamber 11. A stirrer vane 33 is provided at a place at which high-frequency waves generated by the magnetron are received. Further, the high-frequency waves generated from the magnetron 13 are radiated onto the stirrer vane 33 that rotates. Thus, high-frequency waves are supplied into the heating chamber 11 while simultaneously stirred by the stirrer vane 33. Incidentally, the magnetron 13 and the stirrer vane 33 may be provided not only on the bottom part of the heating chamber 11 but on the top surface or a side surface thereof.

The steam generating portion 15 consists of an evaporating dish 35, which has a water storing recess 35*a* adapted to generate steam by being heated as illustrated in FIG. 2, an evaporating dish heater 37 disposed under the evaporating dish 35 for heating the evaporating dish 35 as illustrated in FIG. 3, and a reflector 39, whose section is nearly U-shaped, for reflecting radiation heat of the heater toward the evaporating dish 35. The evaporating dish 35 is made of, for instance, stainless steel and shaped like an elongated plate. Further, the evaporating dish 35 is disposed on the back-side bottom face, which is on the opposite side of the object outlet of the heating chamber, in such a manner as to extend in a direction along the partition plate 27. Incidentally, a glass tube heater, and a sheathed heater may be used as the evaporating dish heater 37.

Figure 5:
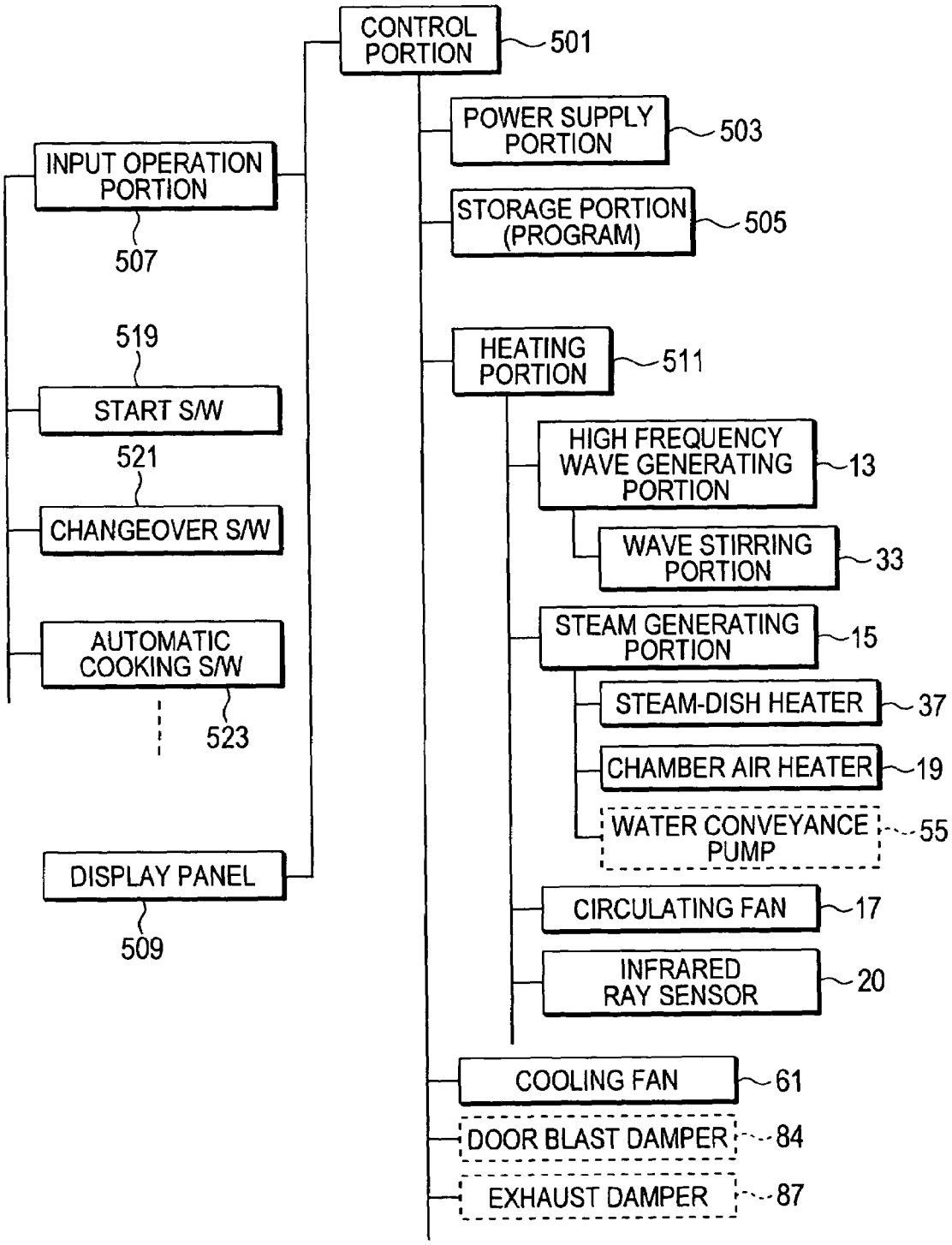
FIG. 5 is a block view illustrating a control system for controlling the high-frequency heating apparatus with a steam generating function.

FIG. 5 is a block view illustrating a control system for controlling the high-frequency heating apparatus with a steam generating function 100. This control system is comprised mainly of a control portion 501 having, for example, a microprocessor. The control portion 501 performs the transfer of signals mainly from and to each of a power supply portion 503, a storage portion 505, an input operation portion 507, a display panel 509, a heating portion 511, and a cooling fan 61.

The input portion 507 is connected to various switches, such as a start switch 519 for instructing to start heating, a change over switch 521 for changing over the heating method, such as a high-frequency heating method and a steam heating method, and an automatic cooking switch 523 for starting execution of a preliminarily prepared program.

The heating portion 511 is connected to a high-frequency wave generating portion 13, a steam generating portion 15, a circulating fan 17, and an infrared ray sensor 20. Further, the high-frequency wave generating portion 13 operates by collaborating with a wave stirring portion (that is, a drive portion for the stirrer vane) 33. The steam generating portion 15is connected to the evaporating dish heater 37, and the chamber air heater 19 (that is, the convection heater). Incidentally, although this block view includes constituent elements (for instance, a water conveyance pump 55, a door blast damper 84, and an exhaust damper 87) other than the aforementioned mechanical constituent elements, such constituent elements other than the aforementioned mechanical constituent elements are described in the following description of another embodiment.

Figure 6:
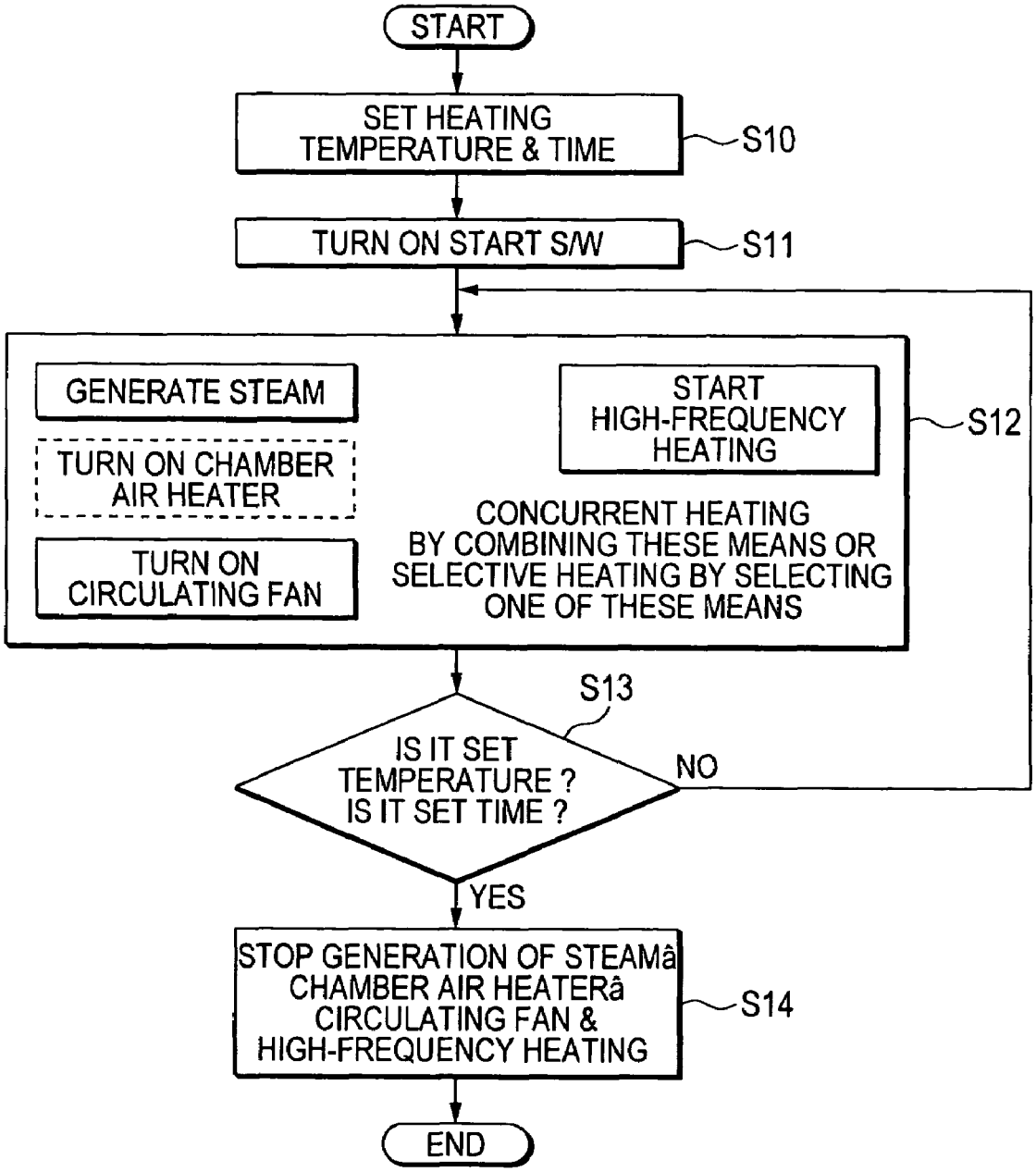
FIG. 6 is a flowchart illustrating a basic operation of the high-frequency heating apparatus with a steam generating function.

Next, a basic operation of the aforementioned high-frequency heating apparatus with a steam generating function 100 is described hereinbelow with reference to a flowchart of FIG. 6.

In an operation procedure, first, food to be heated is put on the dish and then inserted into the heating chamber 11. Subsequently, the opening/closing door 21 is closed. Then, a heating method and a heating temperature or time are set by using the input operation portion 507 at step 10 (hereunder abbreviated as S10). Subsequently, the start switch is turned on (S11). Then, a heat treatment is performed by an operation of the control portion 501 (S12).

That is, the control portion 501 reads the set heating temperature or time, and then selects and performs an optimum cooking method according to the read heating temperature or time, and judges (S13) whether or not the apparatus reaches the set heating temperature or time. When reaching a set value of the heating temperature or time, the apparatus stops each of heat sources and finishes the heating treatment (S14). Incidentally, at S12, generation of steam, an operation of the chamber air heater, rotation of the circulating fan, and a high-frequency heating operation are individually or concurrently performed.

Figure 7:
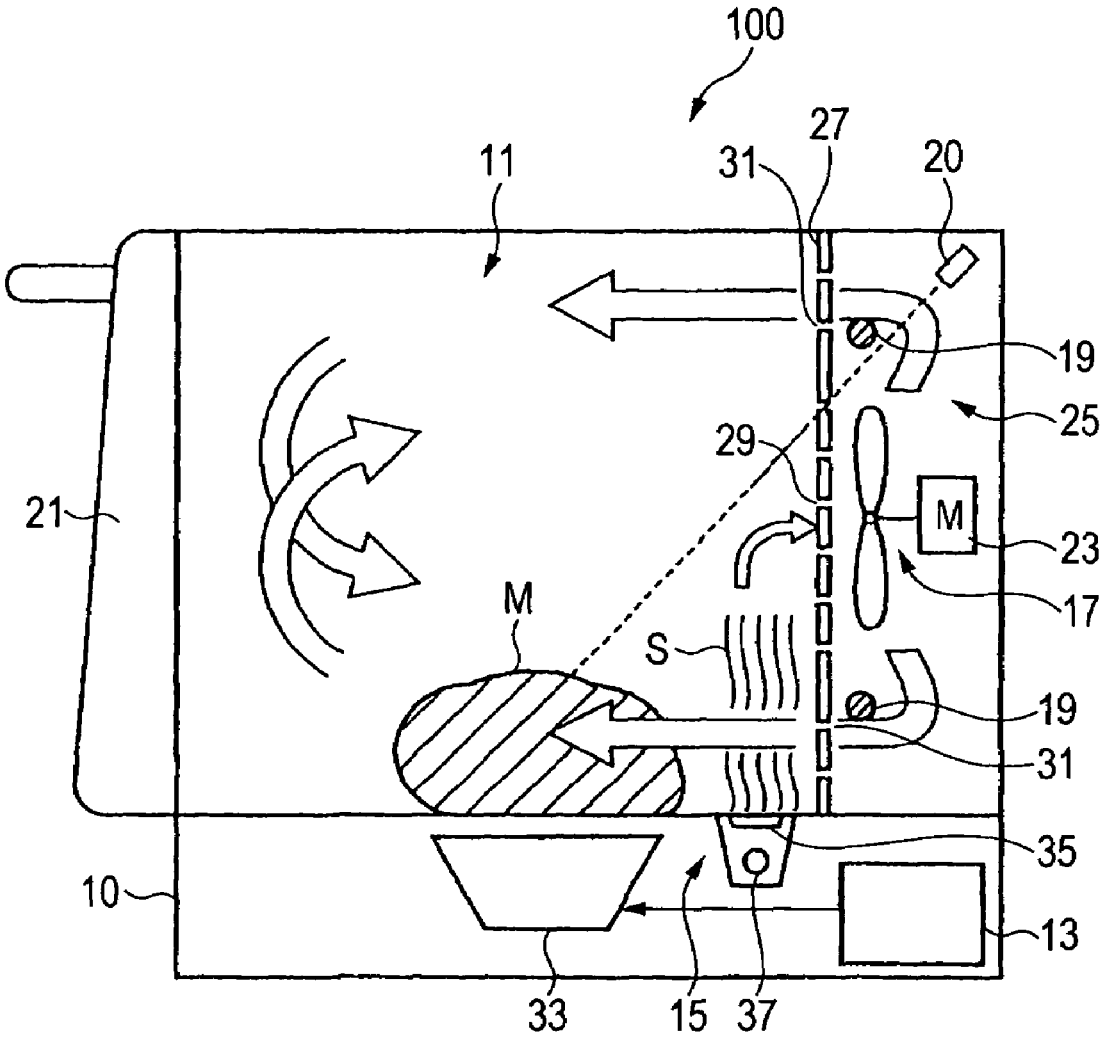
FIG. 7 is a view illustrating an operation of the high-frequency heating apparatus with a steam generating function.

An operation in the case of selecting and performing, for instance, a "steam generation & circulating fan ON" mode during the aforementioned operation is described hereinbelow. When this mode is selected, the evaporating dish heater 37 is turned on, as illustrated in FIG. 7 that illustrates an operation of the high-frequency heating apparatus 100. Thus, water stored in the evaporating dish 35 is heated, so that steam S is generated. The steam S rising from the evaporating dish 35 is drawn into the central part of the circulating fan 17 from the intake ventilation holes 29 provided nearly in the central part of the partition plate 27. Then, the steam is blasted into the heating chamber 11 from the blast ventilation holes 31 provided in the peripheral part of the partition plate 27 through the circulating fan chamber 25. The blasted steam is agitated in the heating chamber 11. Subsequently, the agitated steam is drawn again into the circulating fan chamber 25 from the intake ventilation holes 29 provided nearly in the central part of the partition plate 27. Thus, a circulating path is formed in the heating chamber 11 and the circulating fan chamber 25. Incidentally, the apparatus is configured so that the blast ventilation hole 31 is not provided under the place, at which the circulating fan 17 is provided, on the partition plate 27, and that the generated steam is introduced into the intake ventilation holes 29. Further, as indicated by an outline arrow in this figure, the steam is circulated in the heating chamber 11, so that the steam is blown against the object.

At that time, the steam in the heating chamber 11 can be heated by tuning on the chamber air heater 19. Thus, the temperature of steam circulating in the heating chamber 11 can be set at a high value. Therefore, what is called overheated steam is obtained. Consequently, the overheated steam enables cooking to be performed in such a way as to brown the surface of the object M. Further, in the case of performing the high-frequency heating, the magnetron 13 is turned on. Moreover, the stirrer vane 33 is rotated. Thus, even high-frequency cooking can be performed by supplying high-frequency waves into the heating chamber 11 while agitating the high-frequency waves.

Figure 8:
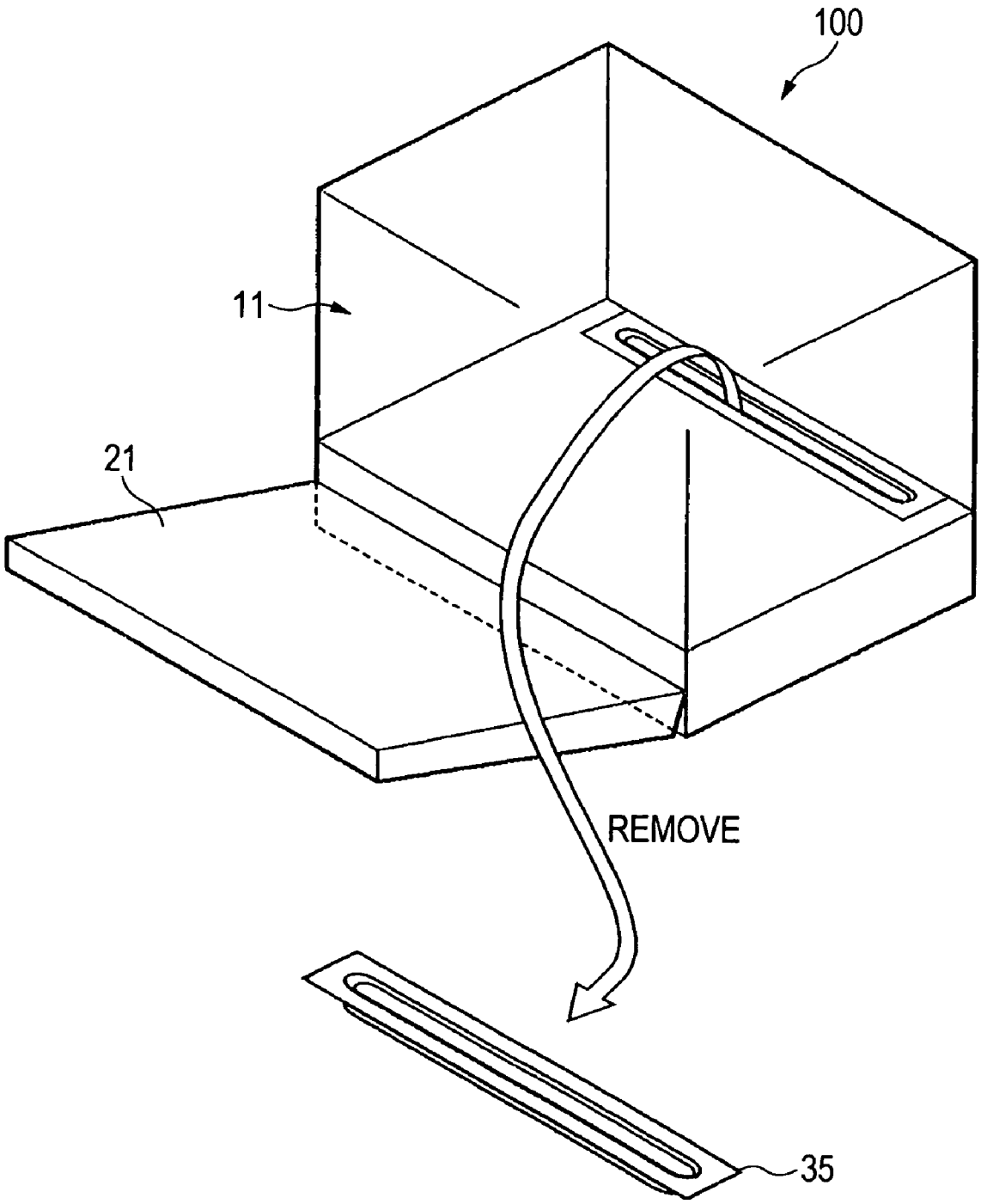
FIG. 8 is a view illustrating a manner in which the evaporating dish is taken out of the heating chamber.

Thus, the high-frequency heating apparatus with a steam generating function according to this embodiment is adapted so that steam is not generated outside, but generated inside the heating chamber 11. Consequently, similarly as the case of cleaning the heating chamber 11, the part for generating steam, that is, the evaporating dish 35 can be simply performed. For example, in the process of generating steam, calcium, magnesium, and chlorine compound contained in water content are sometimes condensed and deposited and fixed onto the bottom portion of the evaporating dish 35. However, the evaporating dish can be cleanly wiped out only by cleaning away substances having adhered to the surface of the evaporating dish 35. Further, when the evaporating dish 35 is awfully stained, the dish 35 may be cleaned by being taken out of the heating chamber 11, as illustrated in FIG. 8. Thus, the cleaning of the evaporating dish 35 can easily be performed. Further, in some case, the evaporating dish 35 can easily be replaced with new one. Therefore, the cleaning of the heating chamber 11 including the evaporating dish 35 is facilitated. Consequently, the internal environment of the heating chamber 11 can be always maintained in a sanitary condition.

Further, this high-frequency heating apparatus is adapted so that the evaporating dish 35 is disposed on the back-side bottom face, which is on the opposite side of the object outlet of the heating chamber 11. Thus, the evaporating dish 35 is not an obstacle to the taking-out of the object. Further, even when the evaporating dish 35 is at a high temperature, there is no fear that a user's hand touches the evaporating dish 35 when the user takes the object into and out of the heating apparatus. Consequently, this heating apparatus excels in safety.

Figure 9:
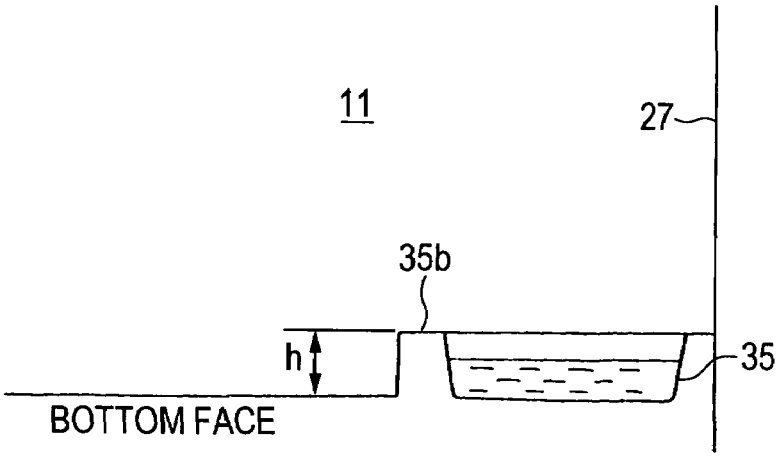
FIG. 9 is a view illustrating the positional relation between the evaporating dish and the bottom surface of the heating chamber.

Furthermore, as is understood from the positional relation between the evaporating dish and the bottom face of the heating chamber, which is illustrated in FIG. 9, the evaporating dish 35 is disposed at a place at which the top face 35*b* of the evaporating dish 35 is at a height h above the bottom face of the heating chamber 11. Thus, liquid, such as juice oozed from the object to the bottom face of the heating chamber 11, from flowing into the evaporating dish through the bottom face of the heating chamber 11. Consequently, the evaporating dish 35 can be maintained in a sanitary condition. Further, a surface 22 of a stepped portion between the evaporating dish 35 and the bottom face is directed to the object outlet. Thus, this surface 22 can be easily cleaned.

Furthermore, in this high-speed heating apparatus, steam is generated by heating the evaporating dish 35 by means of the evaporating dish heater 37. Thus, this high-speed heating apparatus can efficiently supply steam by employing a simple structure. Moreover, steam at a somewhat high temperature is generated by being heated. This enables cooking to be performed simply by humidification, and cooking to be performed by heating an object while the object is prevented by simultaneously performing high-frequency heating from being dried.

Furthermore, the radiation heat of the evaporating dish heater 37 is reflected by the reflector 39 toward the evaporating dish 35. Thus, heat generated by the evaporating dish heater 37 can be efficiently utilized for generating steam without waste.

Further, this high-frequency heating apparatus is adapted so that air in the heating chamber 11 is circulated and agitated by the circulating fan. Thus, when the steam heating is performed, steam can be uniformly circulated all around the heating chamber 11. Therefore, the heating chamber 11 is filled with steam. However, the steam is not retained. Thus, steam can be circulated all over the entire heating chamber 11. Consequently, when the temperature of the object is measured by the infrared ray sensor 20, this infrared ray sensor 20 reliably measures the temperature of the object without measuring the temperature of steam particles in the heating chamber 11. Thus, the accuracy of measurement of the temperature of the object can be improved. Consequently, heating treatment to be conducted by referring to a detected temperature can be properly performed without introducing errors.

Further, both the high frequency heating and the steam heating can be concurrently performed as the heating method. Alternatively, one of the high frequency heating and the steam heating can be individually performed. Alternatively, both the high frequency heating and the steam heating can be performed in a predetermined order. These ways of performing the heating method can be freely chosen and performed. Thus, an appropriate cooking method can be arbitrarily selected according to the kind of food, and to which of a frozen food and a chilled food the object is. Especially, in the case of employing both the high frequency heating and the steam heating, the rate of rise of temperature can be increased. Thus, efficient cooking is enabled.

Further, the apparatus is adapted so that air circulating in the heating chamber 11 can be heated by the chamber air heater 19 equipped in the circulating fan chamber 25. Thus, steam generated in the heating chamber 11 can be freely adjusted. For example, the temperature of steam can be set to be equal to or higher than 100° C. Thus, the temperature of the object can be efficiently raised by overheated steam. Moreover, the surface of the object is dried. In some cases, the surface of the object can be browned. Furthermore, in the case that the object is a frozen food, heat transfer can be efficiently performed owing to large heat capacity of steam. Thus, the object can be quickly defrosted.

Furthermore, in this high-frequency heating apparatus with a steam generating function 100, the circulating fan 17 is accommodated in the circulating fan chamber 25 independently provided outside the heating chamber 11 through the partition plate 27. This eliminates the possibility that juice scattering during the cooking of the object adheres to the circulating fan 17. Simultaneously, ventilation is performed through the ventilation holes 29 and 31 provided in the partition plate 27. Thus, a steam flow caused in the heating chamber 11 can be freely changed according to the positions, at which the ventilation holes 29 and 31 are provided, and to the opening area of the ventilation holes 29 and 31.

Figure 10:
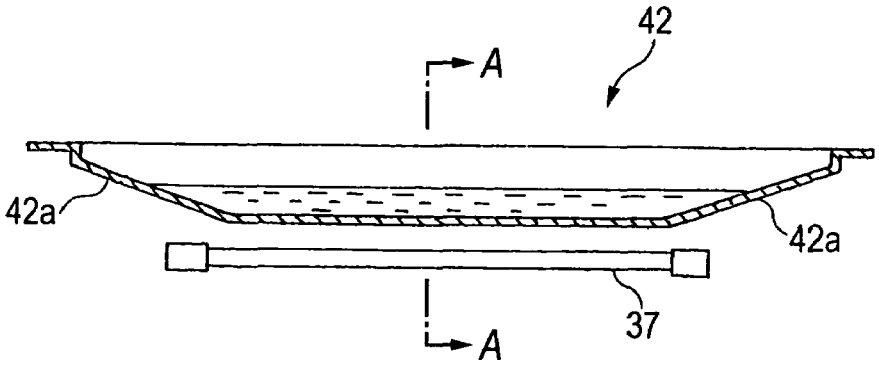
FIG. 10 is a schematic configuration view illustrating a section of another shape of the evaporating dish, and also illustrating the evaporating-dish heater.
Figure 11:
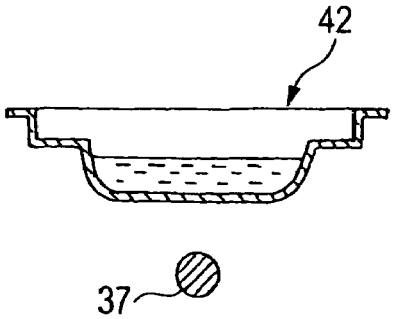
FIG. 11 is a sectional view taken along line A—A of FIG. 10.
Figure 12:
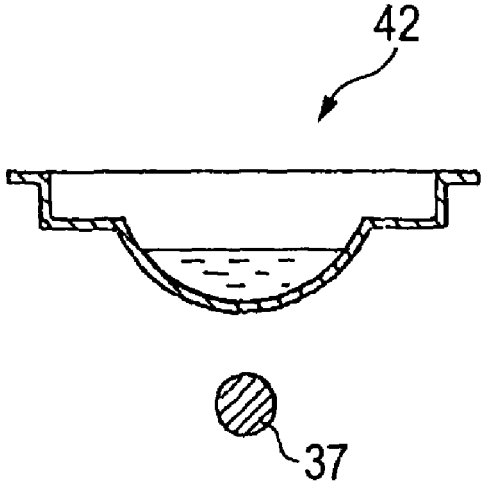
FIG. 12 is a sectional view illustrating another example of a section taken along line A—A of FIG. 10.
Figure 13:
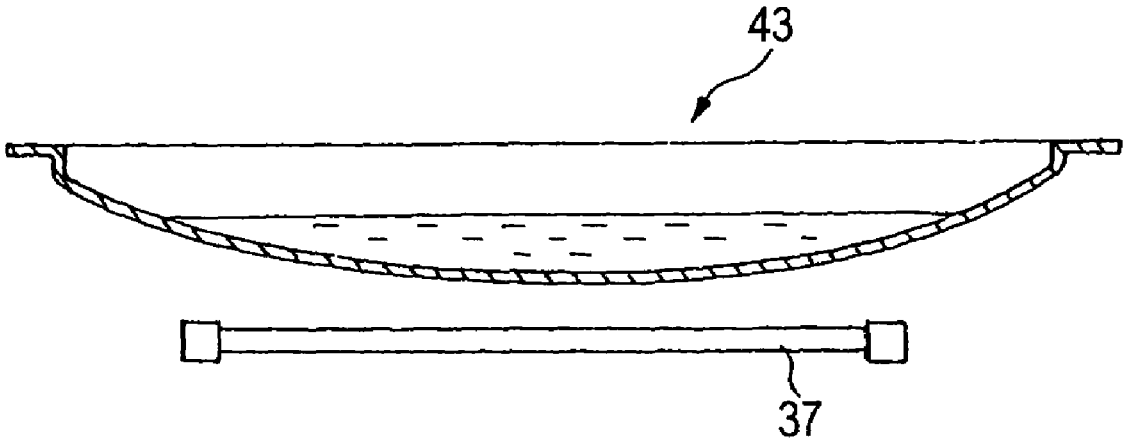
FIG. 13 is a schematic configuration view illustrating still another shape of the evaporation dish.

Incidentally, the aforementioned evaporating dish 35 is configured so that the water storing recess may have one of the following shapes. FIG. 10 shows a schematic configuration view illustrating a section of another shape of the evaporating dish, and also illustrating the evaporating-dish heater. FIG. 11 shows a sectional view taken along line A—A of FIG. 10. FIG. 12 shows another example of a sectional view taken along line A—A of FIG. 10. FIG. 13 shows a schematic configuration view illustrating a section of still another shape of the evaporating dish.

The evaporating dish 42 shown in FIG. 10 has tapered portions 42*a* respectively provided at both end portions thereof so that the water storing recess gradually becomes shallower along a longitudinal direction thereof in each of the tapered portions. Water injected into the water storing recess flows along the tapered portions 42*a* and is stored in the central part of the evaporating dish at all times. With this configuration, the overall length of the evaporating dish heater 37 can be reduced. Thus, a compact evaporating dish heater can be obtained. Further, although a transverse section of the bottom face of the water storing recess may be planar as illustrated in FIG. 11, the transverse section thereof may be shaped like a curved surface, as illustrated in FIG. 12. When the transverse section thereof has a curved surface shape, water stored in the water storing recess is always collected at the lowest position that is close to the evaporating dish heater 37. Thus, the heating efficiency of the apparatus is improved. The evaporating dish 43 shown in FIG. 13 is configured so that the bottom face of the water storing recess is formed along the longitudinal direction in such a manner as to have a curved surface shape. Consequently, water is stored at a place in the proximity of the central part at which heat is concentrated. Hence, heating can be performed by enhancing the heat efficiency.

Figure 14A:
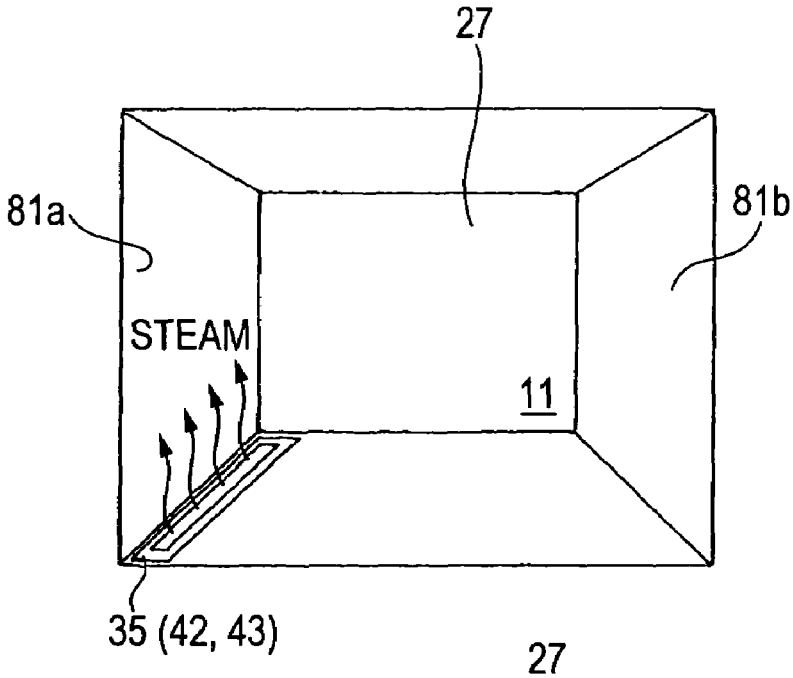
FIGS. 14A and 14B are explanatory views respectively illustrating examples of placement of the evaporating dish.
Figure 14B:
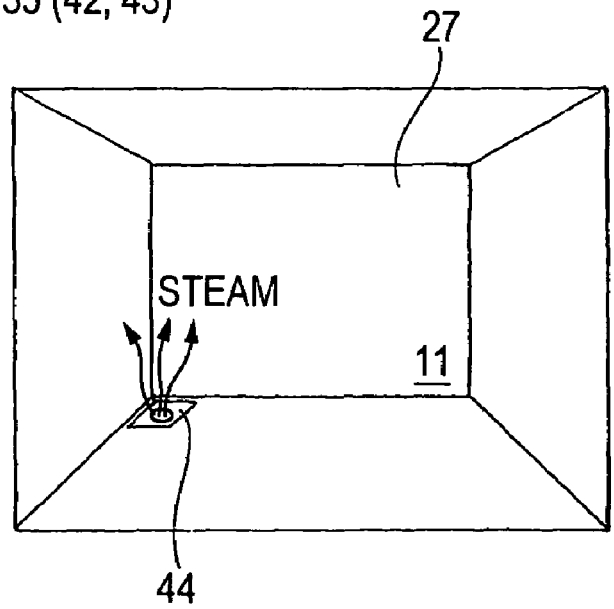

Further, the place, at which the evaporating dish 35 is disposed, in the heating chamber 11 is not limited to the back-side bottom face, which is on the opposite side of the object outlet of the heating chamber 11, and can be suitably changed. Like an example of placement of the evaporating dish shown in FIGS. 14A and 14B, such a place may be the bottom face (in the case of the example illustrated in FIG. 14A, the bottom face at the side of the side wall face 81*a* illustrated in this figure) along one of the side wall surfaces 81*a* and 81*b*. Further, one or more small evaporating dishes 44 shown in FIG. 14B may be disposed at a nook part (or a corner part) of the bottom face of the heating chamber 11. Each of the small evaporating dishes 44 in this case is, for example, a bowl-like evaporating dish having an evaporating dish heater provided on a lower part thereof. Any evaporating dish may be disposed at a given place, as long as steam the evaporating dish can supply steam to the heating chamber. Incidentally, usually, the generated steam flow is an up flow. Thus, it is preferable from the viewpoint of agitation of steam that the evaporating dish is provided under the heating chamber. Preferably, for example, the evaporating dish is provided on a lower half part of the heating chamber or along the bottom face of the heating chamber. Further, when the cleaning of the evaporating dish is easy to perform, the evaporating dish may be provided in a further lower space under the bottom face of the heating chamber. Furthermore, it is possible that the evaporating dish is not fixed to a predetermined place, and that a user can place the evaporating dish at an arbitrary position. In this case, a steam generating source may be positioned at an optimal place according to heating conditions.

SECOND EMBODIMENT

Figure 15A:
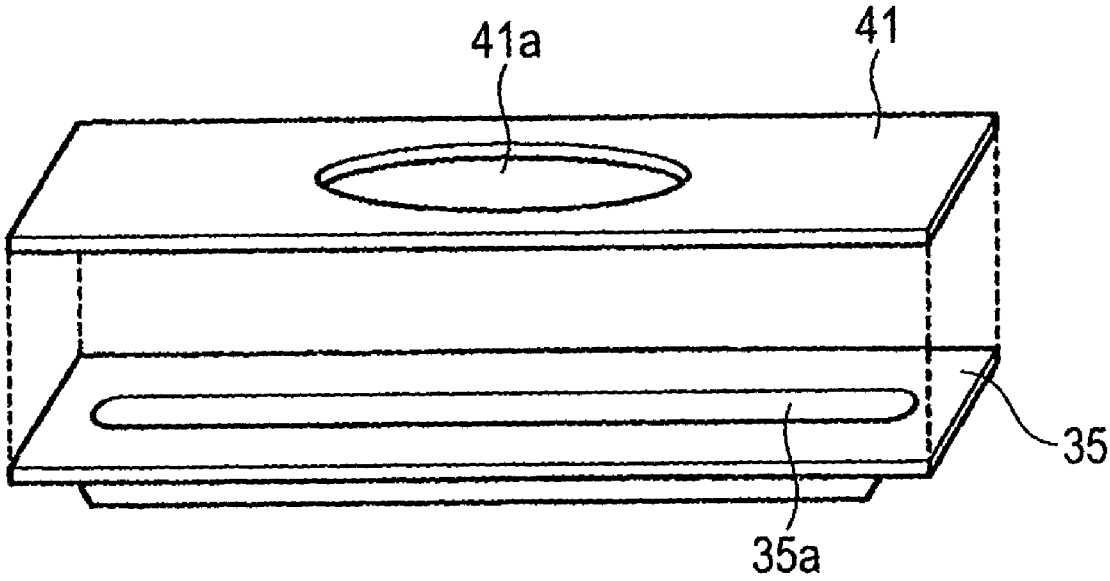
FIGS. 15A and 15B are perspective views illustrating an evaporating dish and a cover of a high-frequency heating apparatus with a steam generating function, which is a second embodiment of the invention.
Figure 15B:
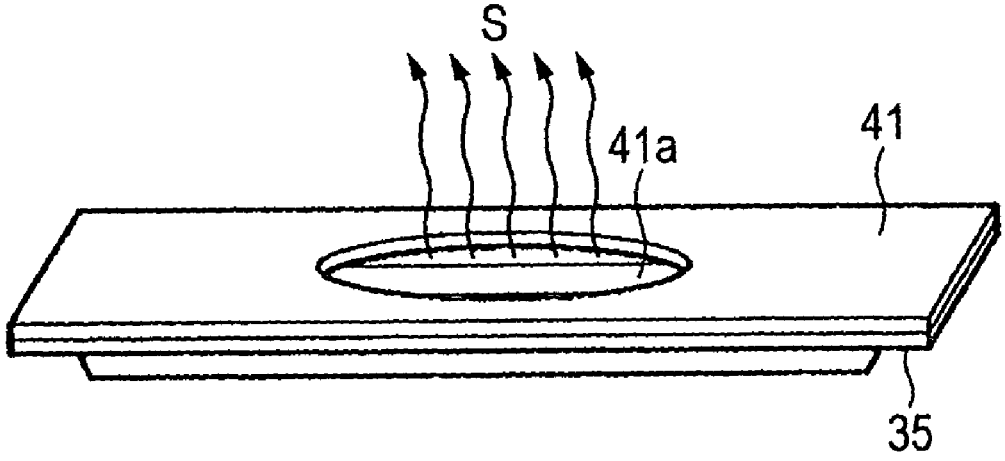

Next, a high-frequency heating apparatus with a steam generating function, which is a second embodiment of the invention, is described hereinbelow by referring to FIGS. 15A, 15B, and 16. Incidentally, in the following description, members, which are the same as those of the first embodiment, are designated by the same reference characters used in the description of the first embodiment. Thus, the description of such members is omitted herein. In the high-frequency heating apparatus with a steam generating function according to the second embodiment, as illustrated in FIG. 15A, the top face of the evaporating dish 35 is covered with a cover 41 provided with an aperture 41*a* formed in a part thereof. Thus, as illustrated in FIG. 15B, the place, from which steam is outputted, can be limited to a certain part of the aperture 41*a*. Further, an amount of supplied steam can be adjusted according to the opening area of the aperture 41*a*.

Figure 16:
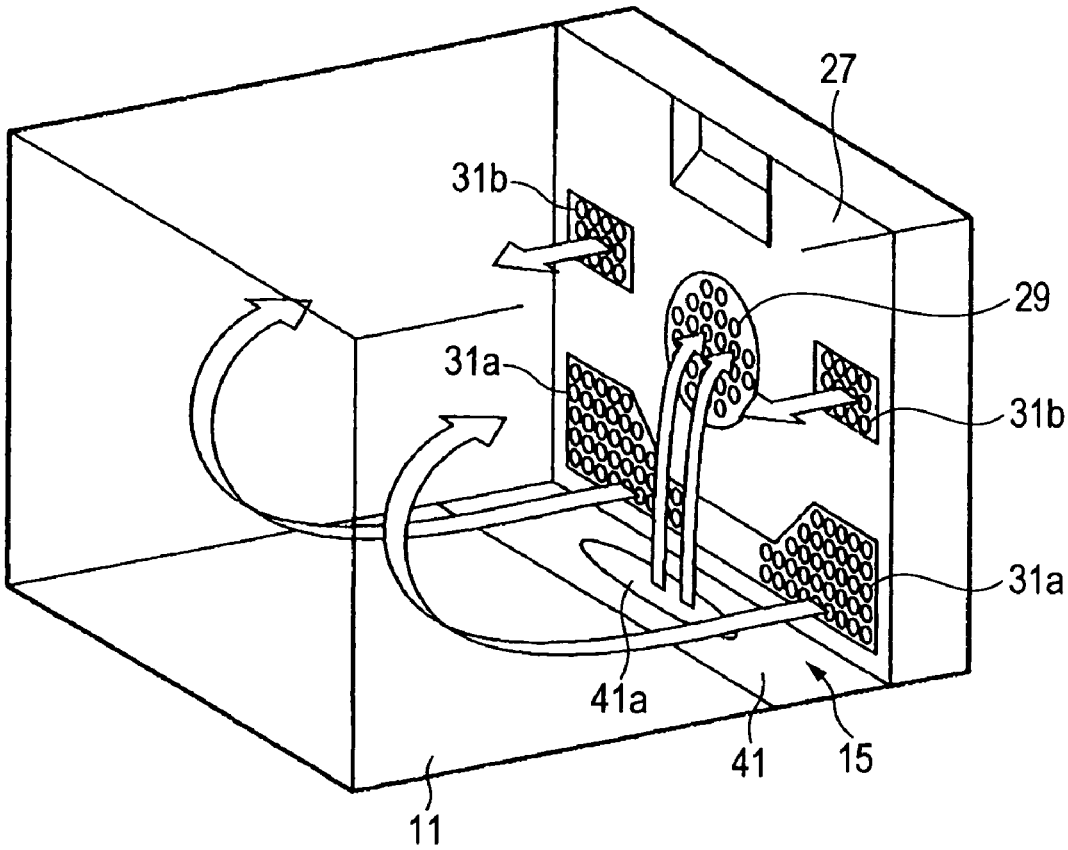
FIG. 16 is an explanatory view illustrating a manner of circulation of steam, which is performed by the high-frequency heating apparatus with a steam generating function.

As shown in FIG. 16, this aperture 41*a* is disposed under the intake ventilation holes 29 provided in the central part of the partition plate 27. Therefore, when the generated steam rises from the aperture 41*a*, the steam is immediately drawn into the intake ventilation holes 29. Thus, the steam becomes a circulating flow, which is circulated in the heating chamber 11, without waste steam. Further, when the cover 41 is detachably constructed, replacement of the cover 41 with another cover having an aperture of a different size is facilitated. Thus, a proper cover may be used according to the heating conditions.

Further, as illustrated in FIG. 16, in this high-frequency heating apparatus with a steam generating function, many blast ventilation holes 31*a* provided in the partition plate 27 are formed in a lower part thereof so that most of steam drawn into the intake ventilation holes 29 can be blasted mainly from a place in the vicinity of the bottom face of the heating chamber 11. This is because of the fact that the steam itself rises, and that thus, when most of the steam is blown out from the lower part, the entire flow can be uniformized, as compared with the case that when most of the steam is blown out from the other part. Thus, a steam flow in the heating chamber 11 goes upwardly after first running low in the vicinity of the bottom face thereof. Incidentally, the blast ventilation holes 31*b* are provided at a nearly half height part of the partition plate 27. This is because a second-stage tray (not shown), on which a to-be-heated object is mounted, is loaded at a nearly half height position of the heating chamber 11, and that it is necessary to send air to the object mounted on this tray.

With this configuration, a circulating flow, by which heating becomes more effective than the heating performed in the aforementioned first embodiment, is generated. Thus, in the distribution of temperature in the heating chamber 11, variation in the temperature is limited in a small range. Therefore, the object put in the heating chamber 11 can be uniformly heated at high speed.

Figure 17:
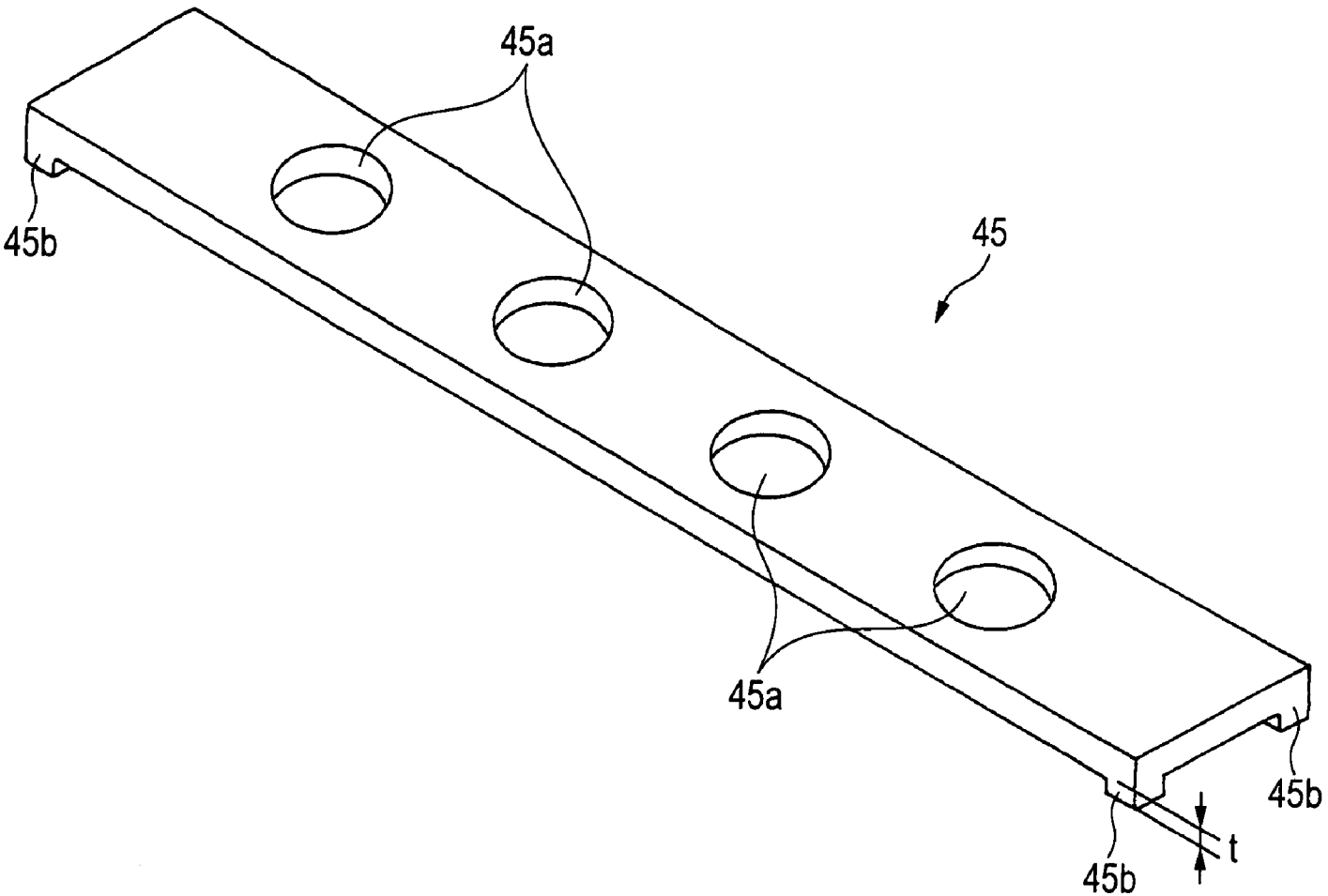
FIG. 17 is a perspective view illustrating the constitution of another cover.

Further, the cover 41 can be replaced with another cover, whose perspective view is shown in FIG. 17. This cover 45 is formed like a plate, in which plural circular apertures 45*a* are provided along the longitudinal direction thereof. Leg portions 45*b* each for forming a gap having a predetermined spacing therefrom to the top face of the evaporating dish 35 are respectively formed at four corners of the back surface of this cover 45 in such a manner as to project therefrom in the direction of thickness thereof. This cover 45 is made of cordierite ($2MgO.\ 2Al_2O_3.5SiO_2$), which is a low dielectric constant material that is low in a wave loss. This cover 45 is resistant to thermal shock, and has a mechanical strength sufficient to the extent that the cover 45 is hard to break.

Figure 18:
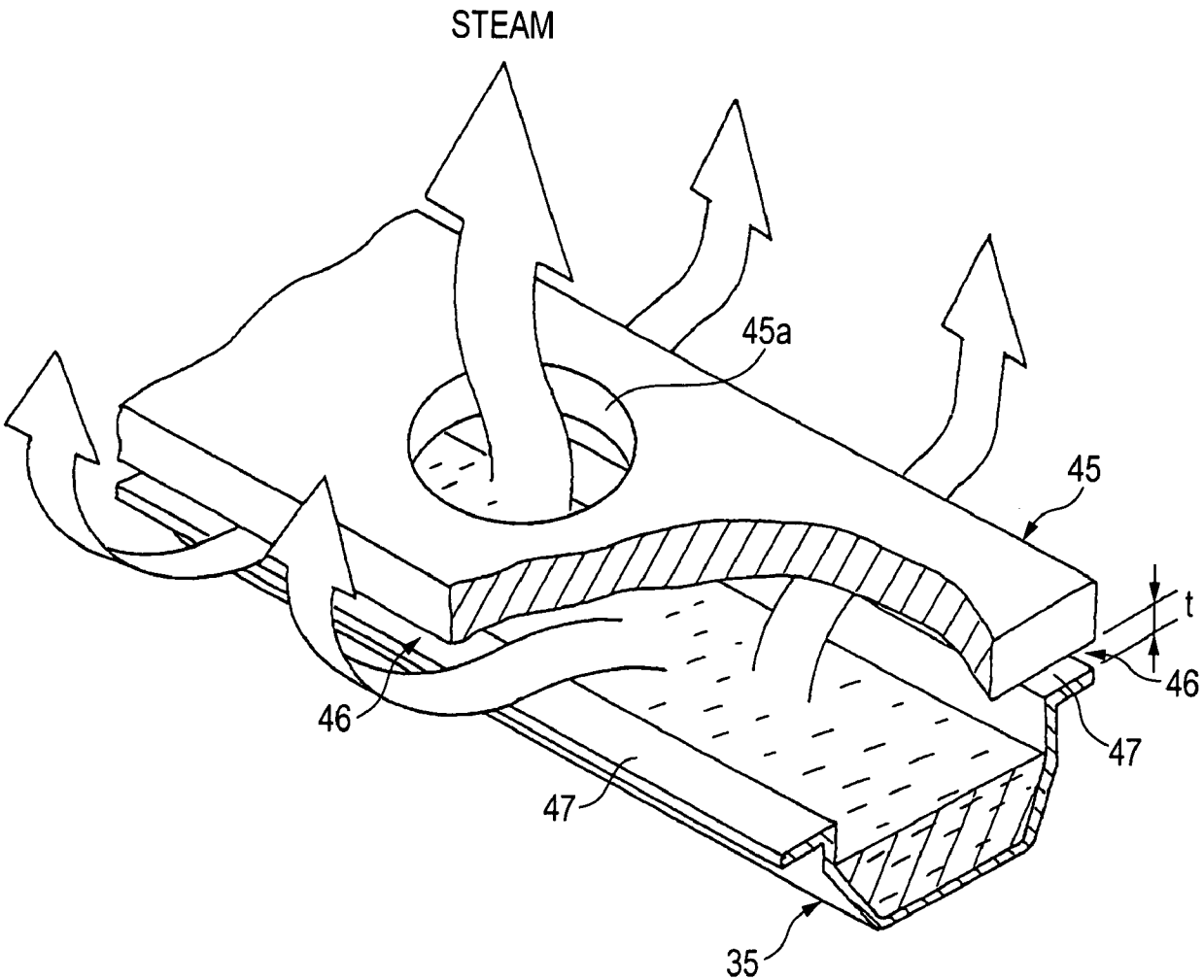
FIG. 18 is an explanatory view illustrating an operation in the case of using the cover shown in FIG. 17.

As illustrated in FIG. 18, a gap 46 having a predetermined spacing t is provided by each of the leg portions 45*b* of the cover 45 to the evaporating dish 35 therefrom. This gap 46 suppresses increase in pressure at the lower part of the cover 45 when water in the evaporating dish 35 is heated. Thus, even when the temperature of water in the evaporating dish 35 rises and a bumping occurs, the pressure is efficiently let out from the gap. This prevents water from scattering from the aperture 45*a*. Therefore, the generated steam stably and upwardly flows from the aperture 45*a*. Incidentally, even when a bumping occurs, a flow path is bent by flange portions 47 provided on both sides of the evaporating dish 35. Thus, water does not scatter from the gap 46. Consequently, water is hardly scattered and stuck to the inside of the heating chamber 11.

Figure 19:
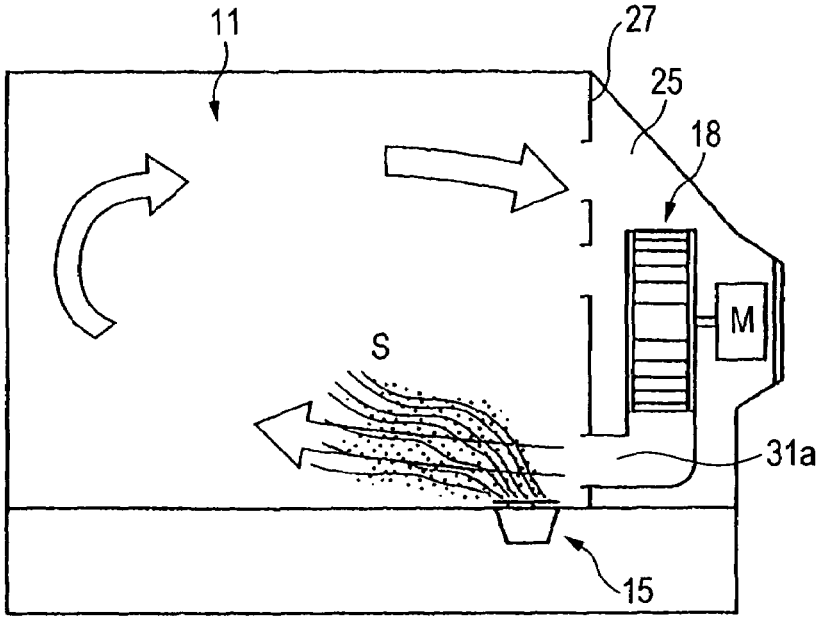
FIG. 19 is a side view illustrating a modification using a sirocco fan.

Incidentally, in the foregoing description, it has been described that a propeller type circulating fan is provided in the apparatus. However, as illustrated in FIG. 19, a sirocco fan 18 may be used as the circulating fan. With this configuration, most of the generated wind can be strongly blown out of the lower blast ventilation holes 31*a*. Therefore, during the heating chamber 11 is filled directly with the steam S generated in the steam generating portion 15, the steam S can be circulated therein.

THIRD EMBODIMENT

Figure 20:
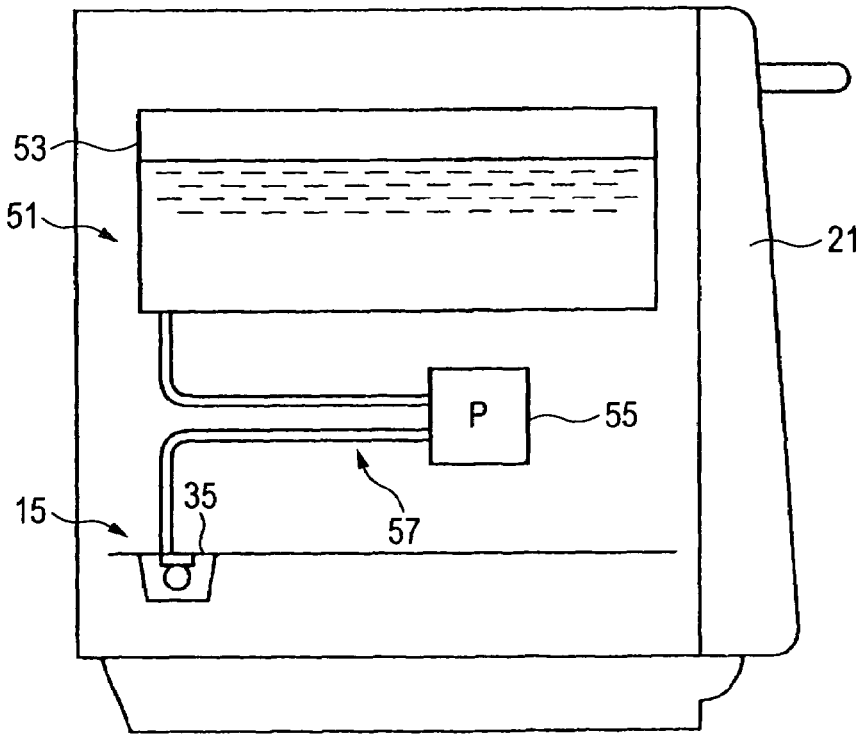
FIG. 20 is a side view illustrating a primary part of a high-frequency heating apparatus with a steam generating function, which is a third embodiment of the invention.
Figure 21:
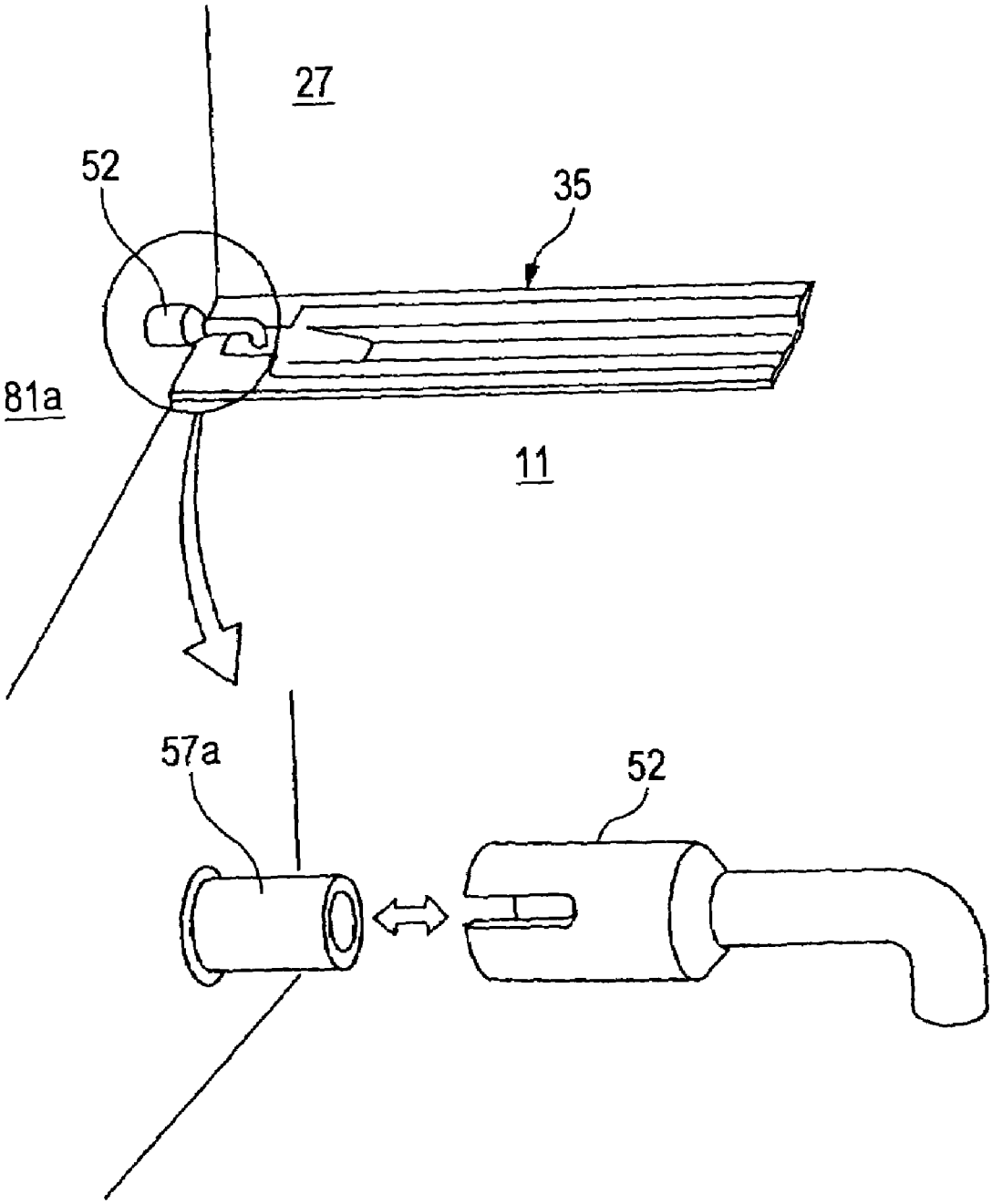
FIG. 21 is an explanatory view illustrating a nozzle attached to an end of a duct.
Figure 22:
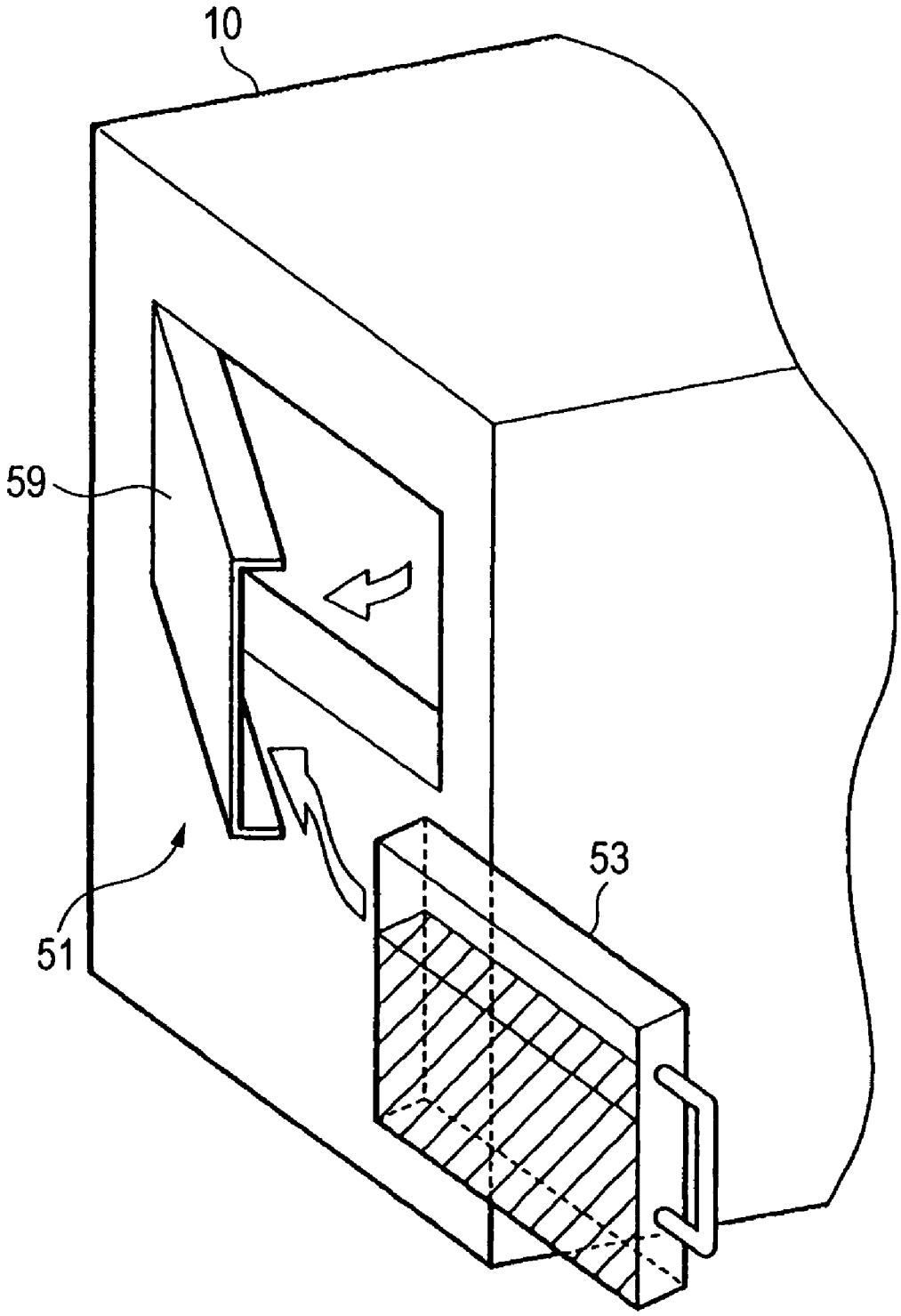
FIG. 22 is an explanatory view illustrating a detachable water storage tank.
Figure 23:
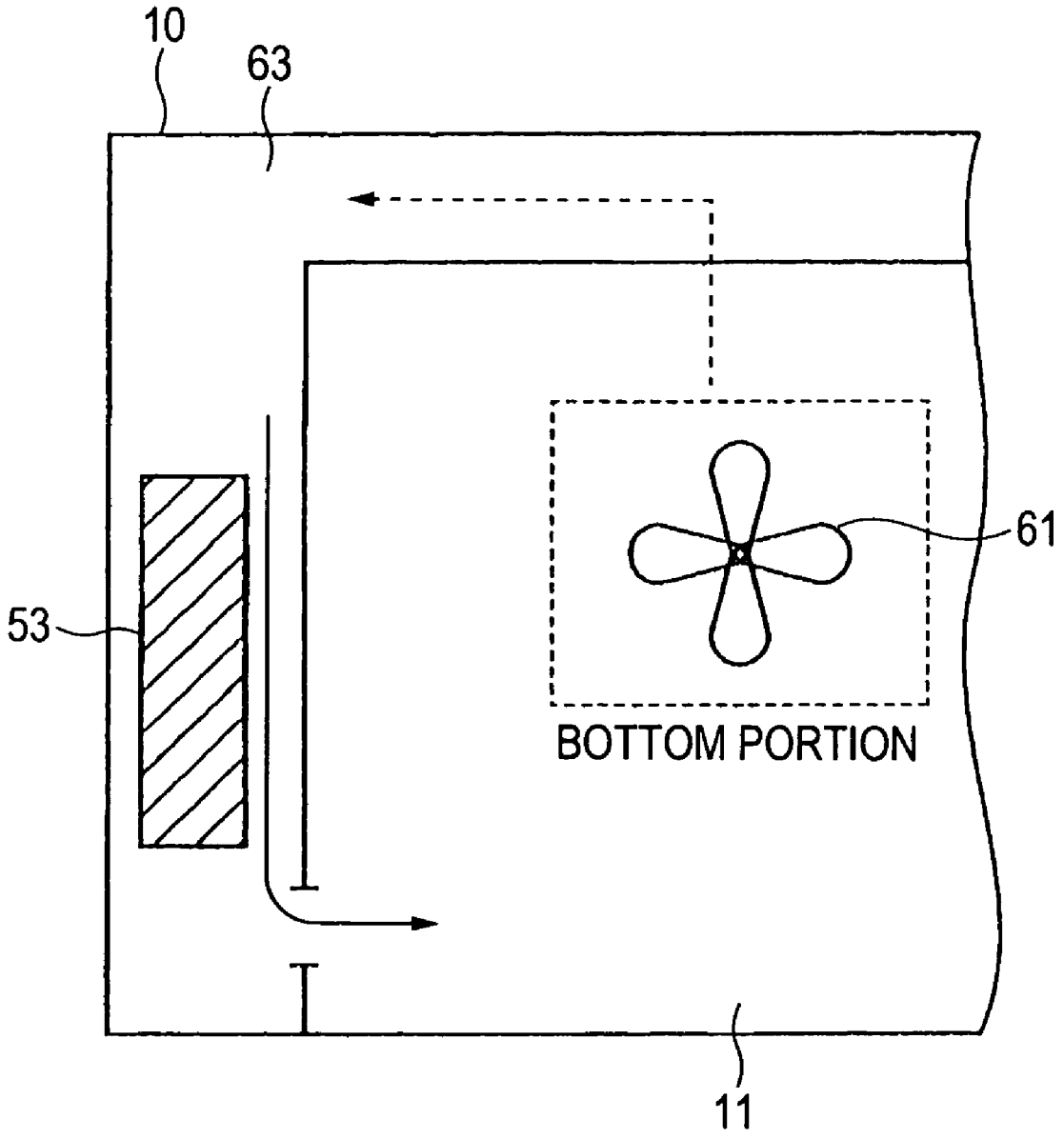
FIG. 23 is a conceptually and partly sectional view illustrating a body case.

Next, a high-frequency heating apparatus with a steam generating function, which is a third embodiment of the invention, is described hereinbelow by referring to FIGS. 20 to 23. FIG. 20 is a side view illustrating a primary part of the high-frequency heating apparatus with a steam generating function, which is this embodiment of the invention. FIG. 21 is an explanatory view illustrating a nozzle attached to an end of a duct. FIG. 22 is an explanatory view illustrating a detachable water storage tank. FIG. 23 is a conceptually and partly sectional view illustrating a body case.

As shown in FIG. 20, the high-frequency heating apparatus with a steam generating function according to this embodiment features that a water supply portion 51 for supplying water to the evaporating dish 35 of the steam generating portion 15 is newly added to the apparatus. The water supply portion 51 has a water storage tank 53, and a water conveyance pump 55 for supplying a predetermined mount of water to the evaporating dish 35 from a water supply tank 53, and a water supply conduit 57 for connecting the water storage tank 53 to the evaporating dish 35.

Further, an end portion 57*a* of the water supply conduit 57, which is provided at the side of the evaporating dish 35, protrudes from the side wall surface 81*a* of the heat chamber 11, as illustrated in FIG. 21. A nozzle 52 made of a flexible heat resistance resin material is attached to this projected end portion 57*a*. Therefore, water in the water storage tank 53 is supplied by the water conveyance pump 55 to the evaporating dish 35 through the water supply conduit 57, and the nozzle 52. Incidentally, the end portion 57*a* of the water supply conduit 57 maybe projected from any of the sidewall surface (for instance, 81*a*) and the wall surfaces of the partition plate 27 at the back side of the heating chamber 11.

With this configuration of this embodiment, water can be continuously supplied to the evaporating dish 35. This enables long-term steam heating. Further, the nozzle 52 is detachably provided in the apparatus. Thus, similarly as the evaporating dish, even when calcium and magnesium contained in water content are sometimes condensed in the process of generating steam and deposited and fixed thereto, or when juice scattered from the object adheres thereto to thereby stain the nozzle 52, the cleaning of the nozzle 52 can be easily completed only by being removed from the end portion 57*a*. Alternatively, the nozzle 52 can be replaced with a new nozzle. This facilitates the maintenance thereof. Thus, the cleaning is facilitated and water can be always supplied to the evaporating dish in a sanitary environment by providing the nozzle 52 at the end portion 57*a* of the water supply conduit 57. Further, the nozzle 52 is made of a soft material. Thus, even when the nozzle 52 touches a food vessel in the heating chamber 11, the nozzle 52 is not damaged. Moreover, the cleaning of the inside of the nozzle 52 is facilitated. Furthermore, when the nozzle 52 is manufactured as an injection mold product formed integrally with the heating chamber 11, the nozzles can be inexpensively supplied by mass production.

Incidentally, the water storage tank 53 is formed as a tank of the cartridge type so as to enhance the tractability thereof, as illustrated in a partly perspective view of a side-face side of the apparatus of FIG. 22. The water storage tank 53 is embedded in a side wall part, whose temperature is relatively difficult to become high, of the body case 10 in a compact manner so as to prevent the apparatus itself from becoming large when the tank 53 is incorporated into the apparatus. Additionally, the tank 53 may be disposed on the top or bottom face side of the apparatus by undergoing heat insulation.

Preferably, the water storage tank 53 of the cartridge type can be externally taken out of the apparatus and easily replaced with a new one. Thus, the tractability thereof can be enhanced. Moreover, the cleaning of the tank is facilitated. For instance, the tank 53 may be enabled to be taken in and out of the apparatus by opening and closing the cover 59 from the side of the apparatus, as illustrated in the figure. Alternatively, the tank 53 may be enabled to be taken in and out of the apparatus from the front face thereof. Furthermore, preferably, the apparatus is configured so that the water storage tank 53 of the cartridge type is formed from a transparent material, such as a resin or glass, that a body-case-side wall of a tank accommodating portion is made of a transparent material, and that the remaining amount of water stored in the water storage tank 53 can be externally and visually checked. Further, an occurrence of an empty evaporating dish 35 can be prevented by attaching a remaining-amount sensor to the apparatus and indicating the remaining amount of water, which is stored in the water storage tank 53, on the display panel 509 or sounding a buzzer by using a loud speaker (not shown).

Incidentally, in the case that the resin water storage tank 53 is disposed in the side wall portion of the apparatus, the water storage tank 53 may be affected by heat outputted from the heating chamber 11. In this case, as illustrated in a conceptual partly sectional view of the body case 10 shown in FIG. 23, the water storage tank 53 is disposed in the middle of a ventilation flue 63 for sending cooling wind into the heating chamber 11 from the cooling fan 61 (for example, a fan, disposed on the bottom portion of the apparatus, for cooling the high frequency wave generating portion 13 during performing high-frequency heating is utilized as the cooling fan). In such a case, the influence of heat, which the water storage tank 53 undergoes, can be minimized. The range of choice of a material of the tank can be widen. This reduces the need for protecting the water storage tank 53 by using the insulating material.

FOURTH EMBODIMENT

Next, a high-frequency heating apparatus with a steam generating function, which is a fourth embodiment of the invention, is described hereinbelow by referring to FIG. 24.

Figure 24:
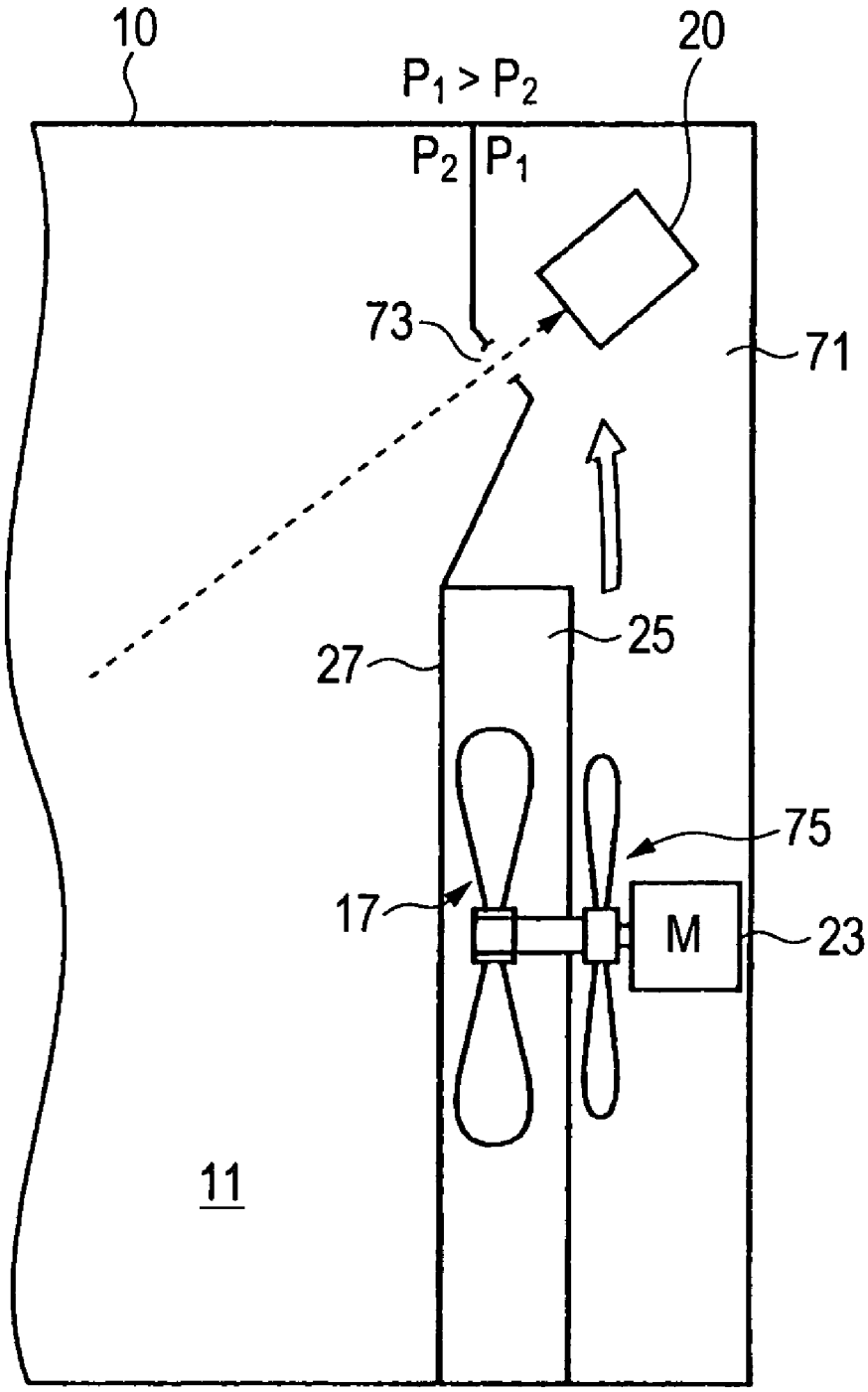
FIG. 24 is a longitudinal side view illustrating a primary part of a high-frequency heating apparatus with a steam generating function, which is a fourth embodiment of the invention.

As is seen from a conceptual longitudinally sectional view of the back-side portion of the body case 10 illustrated in FIG. 24, in addition to the heating chamber 11 and the circulating fan chamber 25, a self-cooled fan chamber 71 partitioned from both the chambers 11 and 25 is provided therein. This self-cooled fan chamber 71 accommodates an infrared ray sensor 20 for detecting the temperature in the heating chamber 11 through a detection hole 73 provided in the wall surface of the heating chamber 11, and a self-cooled fan 75, concentrically provided with a drive shaft of the circulating fan 17, for cooling a drive motor 23. Further, the pressure $P_1$ in the self-cooled fan chamber 71 in the vicinity of the detection hole 73 is maintained by wind pressure due to rotation of the self-cooled fan 75 at a value that is higher than the pressure $P_2$ in the heating chamber Generally, in the case that a protective transparent member, such as glass, is attached to the detection hole 73 when the temperature in the heating chamber 11 is measured by the infrared ray sensor 20, steam sticks to the glass, so that accurate measurement thereof cannot be achieved. Thus, the detection hole 73 is formed as a simple through hole, without attaching an interposition thereto. However, in the case of a through hole, air coming from the heating chamber 11 freely enters the through hole. Thus, steam may stick to the infrared ray sensor 20. Consequently, the accuracy of measurement of the temperature of the object is degraded.

To deal with this problem, the high-frequency heating apparatus with a steam generating function is adapted so that the pressure $P_1$ in the self-cooled fan chamber 71 in the vicinity of the detection hole 73 is maintained by wind pressure due to rotation of the self-cooled fan 75 at a value that is higher than the pressure $P_2$ in the heating chamber 11. Thus, air in the heating chamber 11 can be prevented from entering the self-cooled fan chamber 71 that accommodates the infrared ray sensor 20. Therefore, detection accuracy can be prevented from being degraded owing to adhesion of stain to the infrared ray sensor 20. This enables heat-treatment under accurate temperature management. Consequently, the adjustment of the degree of heating can be achieved as desired.

Figure 25A:
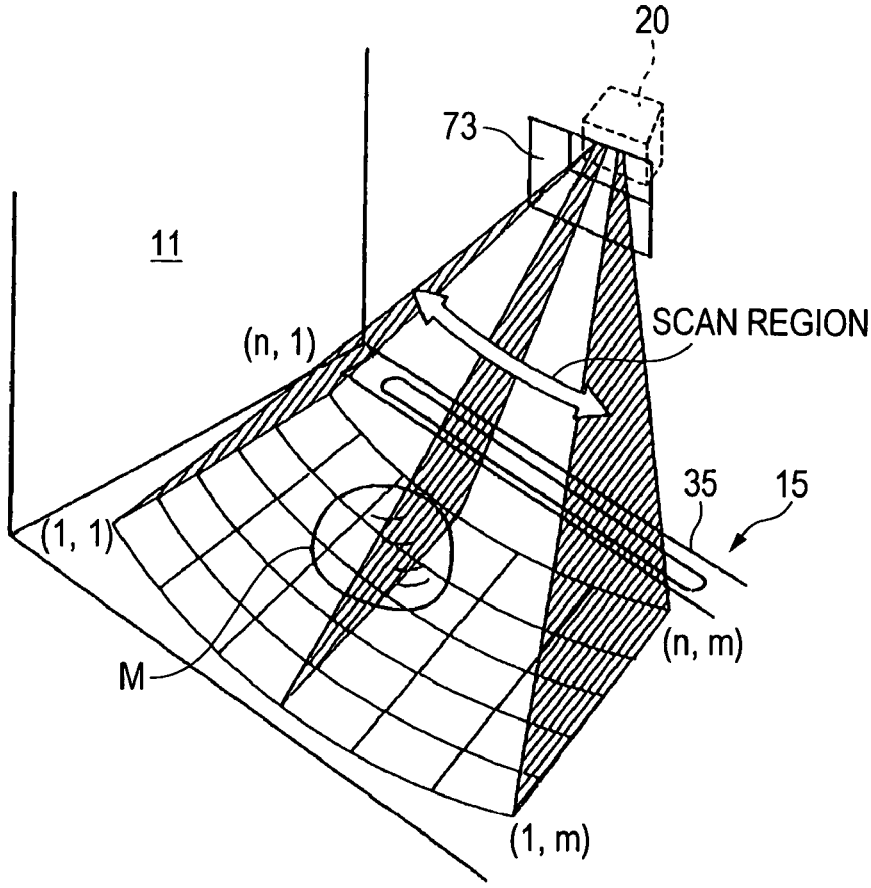
FIGS. 25A and 25B are explanatory views illustrating a manner of measuring the temperature of an object by using an infrared ray sensor.
Figure 25B:
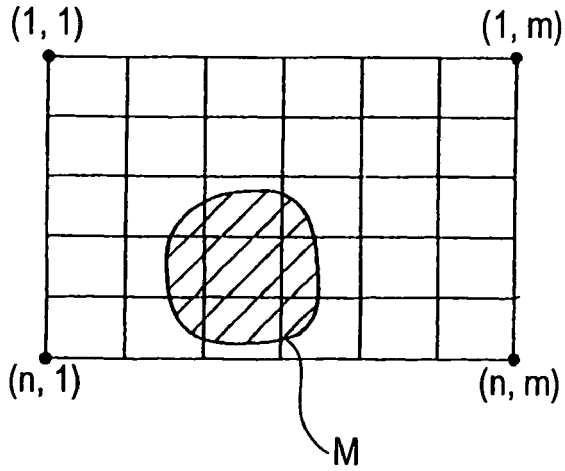

Hereunder, a temperature measuring method using the infrared ray sensor 20 is described. FIGS. 25A and 25B are explanatory views illustrating a manner of measuring the temperature of the object by using the infrared ray sensor. The infrared ray sensor 20 performs scanning in the direction of an arrow in FIG. 25A by swinging itself while the temperatures at a plurality of points (n points) are simultaneously detected at a time. Thus, the infrared ray sensor 20 detects the temperatures at a plurality of measurement points (m points arranged in a scanning direction) in the heating chamber 11. Therefore, the temperatures at n×m measurement points shown in FIG. 25B can be detected by performing the scanning once. The temperature of the object M is determined by finding a position, at which the object M is put on, according to a rate of increasing the temperature, which is continuously detected at each of the measurement points, to an elapsed time, and treating the temperature, which is detected at the found position, as the temperature of the object M.

A range, in which the infrared ray sensor 20 measures the temperature, is the bottom face of the heating chamber 11 except the place at which the evaporating dish 35 is disposed. Therefore, the evaporating dish 35 is disposed at a place that is substantially outside a range in which temperature measuring waves are irradiated from the infrared ray sensor 20. Incidentally, the apparatus may employ a method according to which the temperature measurement is conducted by causing the infrared ray sensor 20 to perform scanning on the entire bottom surface of the heating chamber 11, and then invalidating data detected at the position of the evaporating dish 35.

FIFTH EMBODIMENT

Next, a high-frequency heating apparatus with a steam generating function, which is a fifth embodiment of the invention, is described hereinbelow by referring to FIG. 26.

Figure 26:
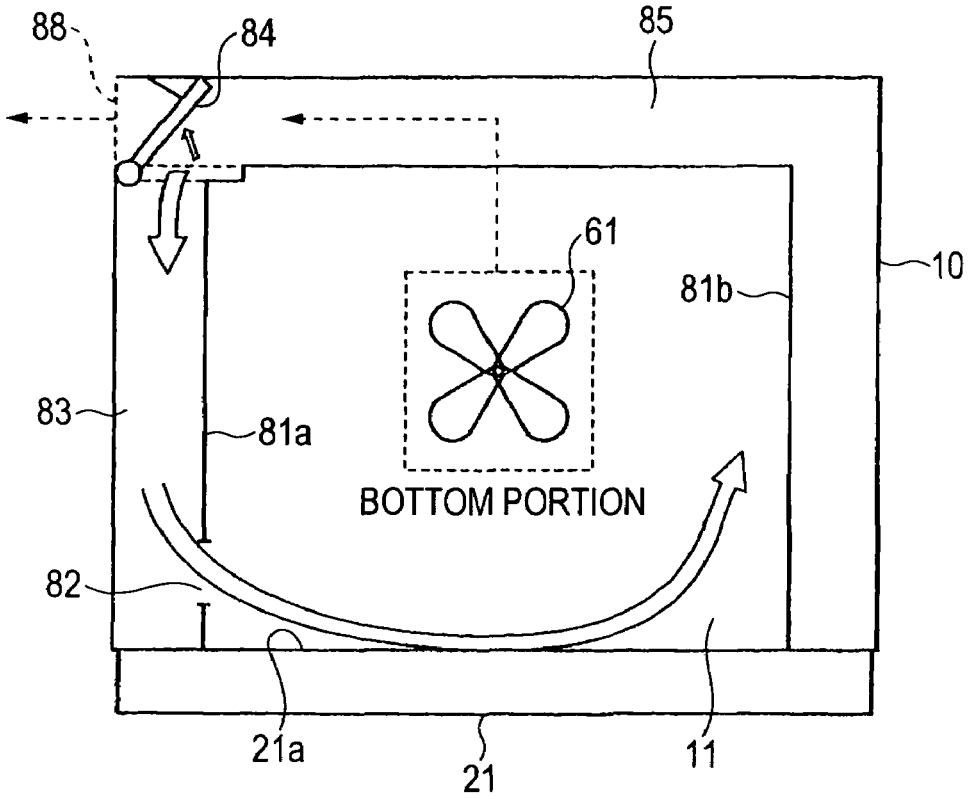
FIG. 26 is a plan view illustrating the outline configuration of a high-frequency heating apparatus with a steam generating function, which is a fifth embodiment of the invention.

As is seen from a conceptual transverse sectional view of the body case 10 shown in FIG. 26, the high-frequency heating apparatus with a steam generating function according to this embodiment is constructed so that an outside-air supply opening 82, from which outside-air is blown against the inner surface of the translucent window 21*a* of the opening/closing door 21, is provided in a side wall surface 81*a* in the vicinity of the opening/closing door 21 of the heating chamber 11. The outside-air supply opening 82 is formed in such a way as to communicate with a side portion ventilation flue 83 secured between the body case 10 and the side wall surface of the heating chamber 11. A rear portion ventilation flue 85 is connected to the side portion ventilation flue 83 through a damper 84. Furthermore, the apparatus is adapted so that wind sent from the cooling fan 61 provided in the bottom portion of the apparatus is blown into the heating chamber 11 from the outside-air supply opening 82 through the side portion ventilation flue 83 by switching the damper 84. Incidentally, when the damper 84 is switched to the other damping condition, cooling wind is exhausted from an exhaust outlet 88 to the outside.

Thus, outside-air is blown against the inner surface of the translucent window 21*a*, so that the translucent window 21*a* is prevented from being steamed up when the steam heating or the high-frequency heating is performed. The condition of the heated object in the heating chamber 11 can be externally and visually checked. Incidentally, it is sufficient that the blowing of outside air is performed only when needed. For example, in the case that the blowing of outside-air is started a predetermined time before the finish of the heating, the translucent window 21*a* is defogged at the finish of the heating. Moreover, steam can be restrained from growing dense at the near side when the door is opened. Furthermore, the apparatus is configured so that outside-air is blown against the translucent window 21*a* by being forcibly introduced. Thus, this embodiment particularly excels in the effect of expelling steam (that is, the cooling effect) before the opening/closing door 21 is opened.

SIXTH EMBODIMENT

Next, a high-frequency heating apparatus with a steam generating function, which is a sixth embodiment of the invention, is described hereinbelow by referring to FIGS. 27 and 28.

Figure 27:
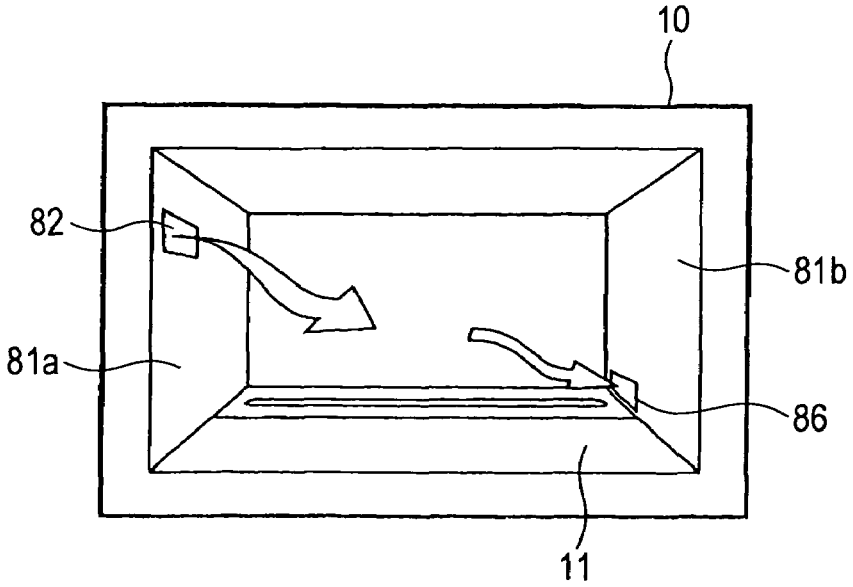
FIG. 27 is a front view illustrating the outline configuration of a high-frequency heating apparatus with a steam generating function, which is a sixth embodiment of the invention.
Figure 28:
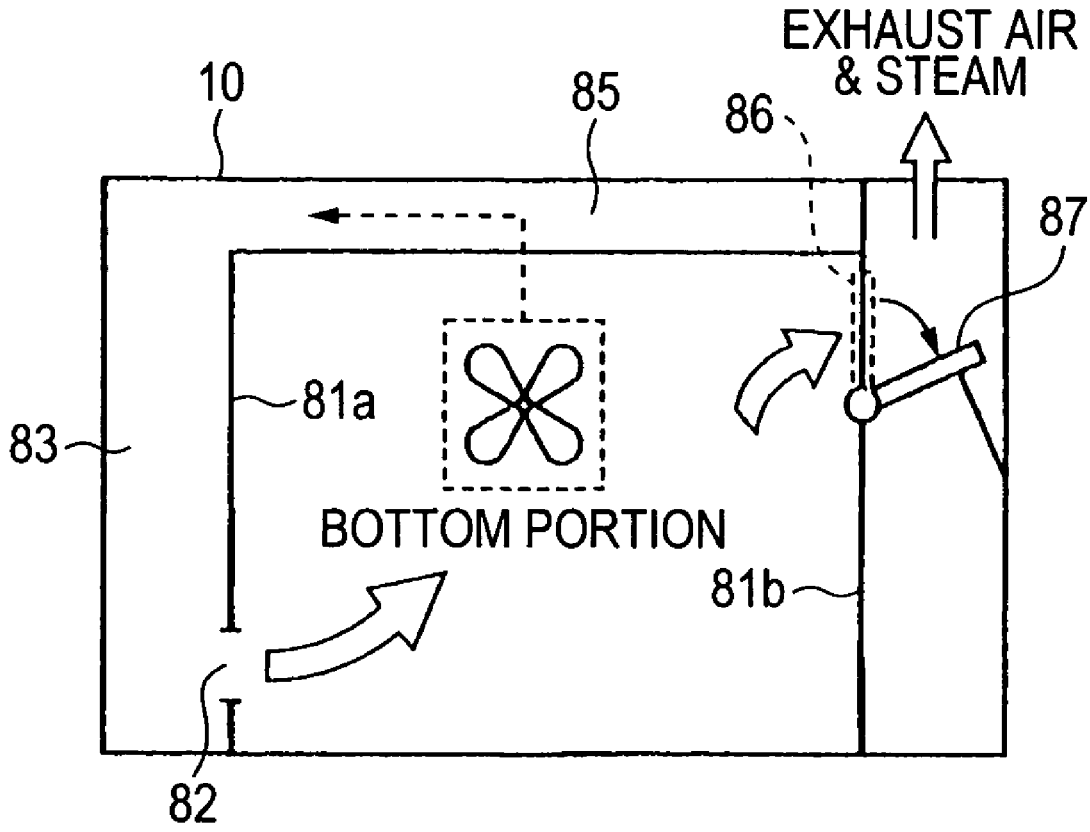
FIG. 28 is a plan view illustrating a ventilation duct of the apparatus shown in FIG. 27.

As is seen from a front view of the outline configuration of the body case shown in FIG. 27, and as is seen from a plan view illustrating a ventilation duct shown in FIG. 28, the high-frequency heating apparatus with a steam generating function according to this embodiment is configured so that the outside-air supply opening 82 is disposed at the near side of the upper part of one 81*a* of the sidewall surfaces of the heating chamber 11, and that the exhaust outlet 86, from which air in the heating chamber 11 is exhausted, is disposed at the back-side of the lower part of the other side wall surface 81*b* of the heating chamber 11. In this case, the exhaust outlet 86 is directly connected to the outside through the damper 87. Thus, the apparatus is adapted so that air and steam in the heating chamber 11 can be immediately and externally exhausted.

Thus, an air flow in the heating chamber 11 at exhaustion is directed from the top face side to the bottom face side by positioning the exhaust outlet 86 in the vicinity of the bottom face of the heating chamber 11. Consequently, the air in the heating chamber 11 can be effectively exhausted without causing air to stagnate. Further, the destination of exhausted air is outside the apparatus, so that the exhausted air becomes outside-air. Thus, this embodiment has an effect of restraining evaporants, which are generated from the object, from adhering onto the inner wall of the apparatus. Further, the outside-air supply opening 82 is provided at the near side, while the exhaust outlet 86 is provided at the back-side of the heating chamber 11. Thus, a flow of air to be exhausted from the heating chamber 11 runs diagonally across a rectangular parallelepiped space in the heating chamber 11. Consequently, quick ventilation can be more efficiently performed.

SEVENTH EMBODIMENT

Next, a high-frequency heating apparatus with a steam generating function, which is a seventh embodiment of the invention, is described hereinbelow by referring to FIG. 29.

Figure 29:
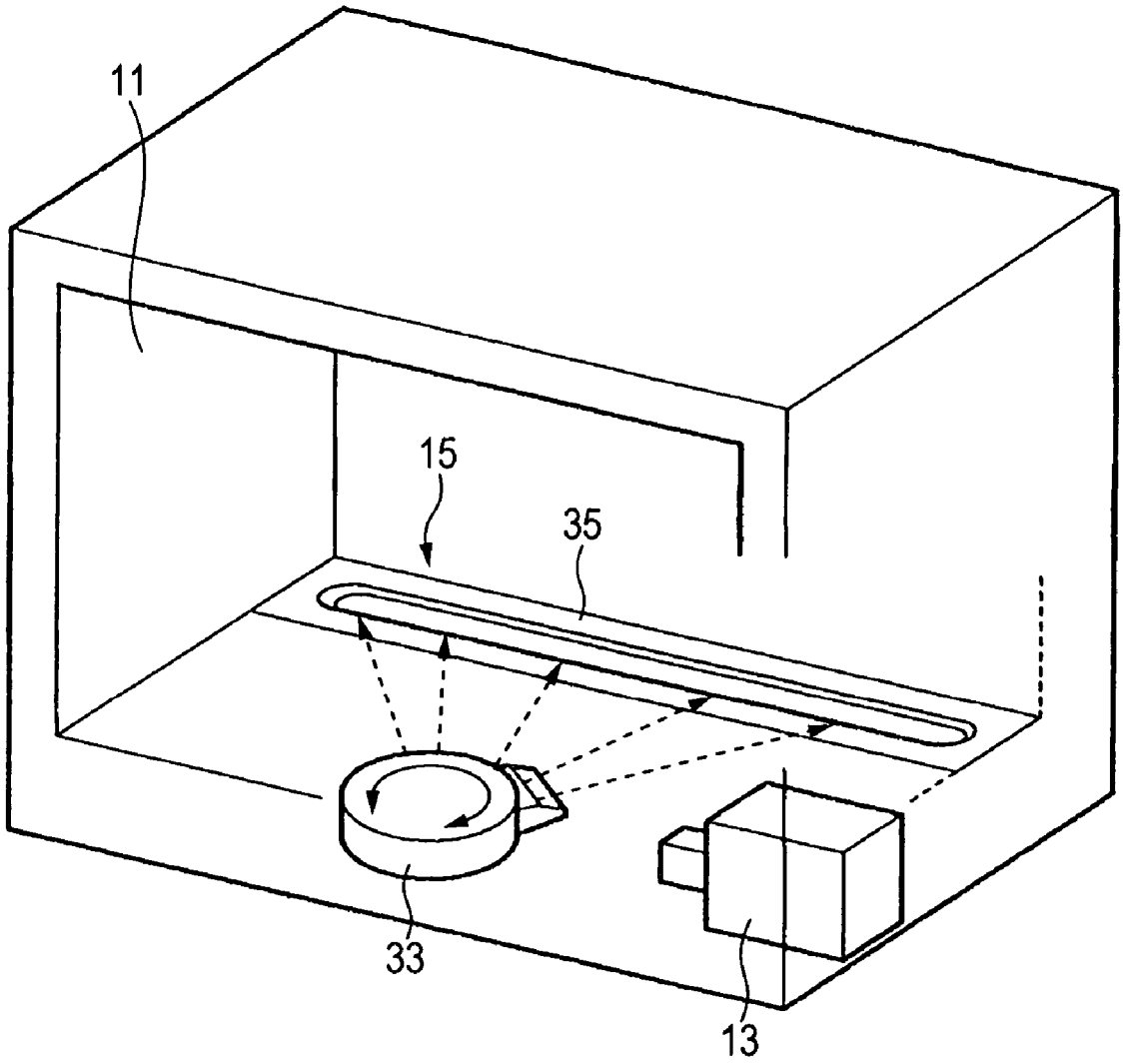
FIG. 29 is a schematic configuration view illustrating the outline configuration of a high-frequency heating apparatus with a steam generating function, which is a seventh embodiment of the invention.

As is seen from a schematic configuration view of the apparatus shown in FIG. 29, water in the evaporating dish 35 is evaporated by the high-frequency heating without providing an evaporating dish heater in the apparatus. In this case, although water in the evaporating dish 35 may be high-frequency-heated by being agitated by the ordinary stirrer vane 33, it is preferable that the stirrer vane 33 is designed in such a way as to enable high-frequency waves outputted by the stirrer vane 33 to be directed to the evaporating dish 35, and as to enable the evaporating dish 35 to be intensively heated. This is realized by stopping the stirrer vane 33, which usually rotates to thereby uniformly heat the entire heating chamber 11, at a specific place. For instance, in the case that a control operation is performed in such a way as to cause the apparatus to resume ordinary heat-treatment of after water in the evaporating dish 35 is intensively heated for a predetermined time, both the generation of steam and the high-frequency heating can be simultaneously performed without providing an evaporating dish heater in the apparatus.

Thus, the evaporating dish heater is omitted. Further, water in the heating chamber 11 is heated and vaporized by utilizing high frequency waves. Consequently, the configuration of the apparatus can be simplified. Moreover, the cost of the apparatus can be reduced.

Figure 30:
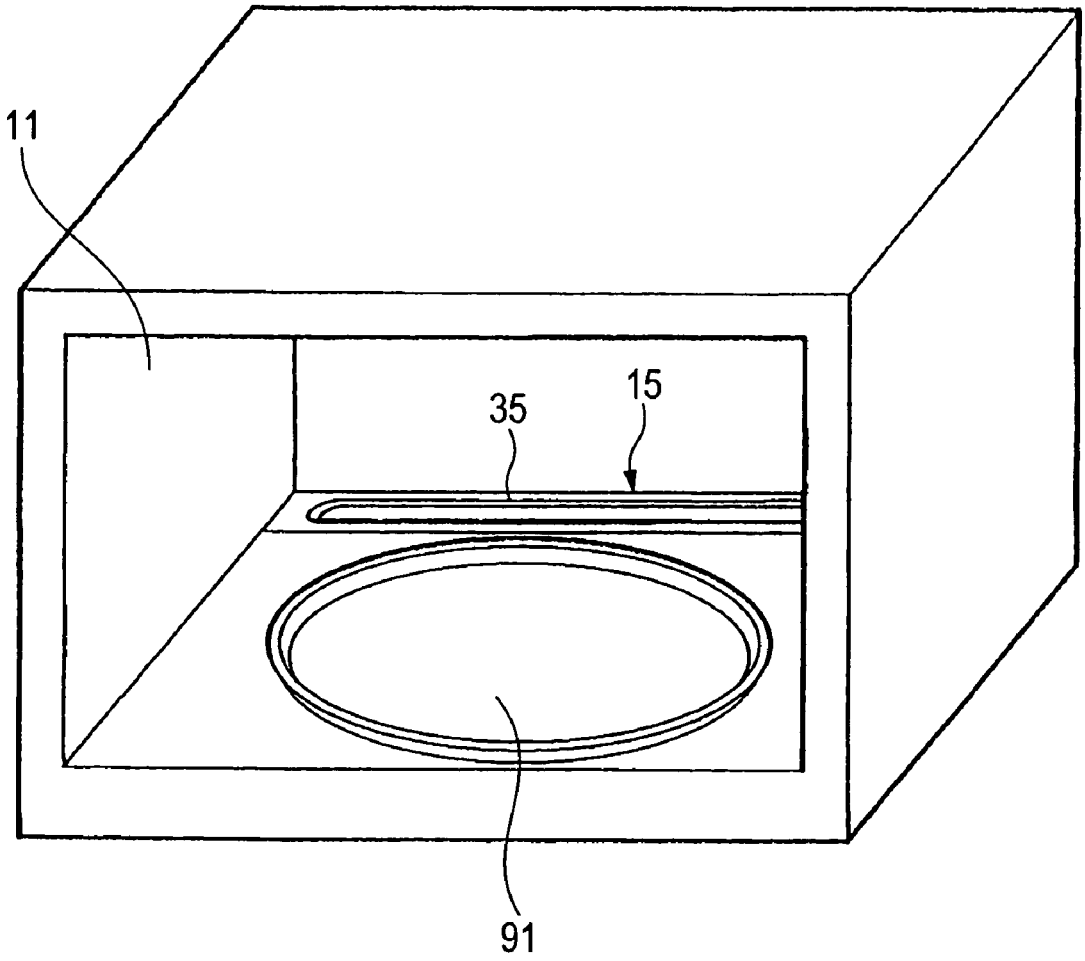
FIG. 30 is a perspective view illustrating an example of the configuration of the apparatus having a turntable.

Incidentally, in the foregoing description of the aforementioned embodiments, it has been described that the stirrer vane 33 is provided in the apparatus so as to stir high frequency waves. However, the invention can be similarly applied to an apparatus of the configuration, in which an object to be heated is uniformly heated by using a turntable 91, as illustrated in FIG. 30. That is, the generation of steam can be achieved by such an apparatus, which is by no means inferior to the aforementioned embodiments in the steam generating function, by disposing the turntable 91 at the near side of the evaporating dish 35, as viewed in this figure, on the inner bottom face of the heating chamber 11 except the place, on which the evaporating dish 35 is disposed, in the illustrated case.

Figure 31A:
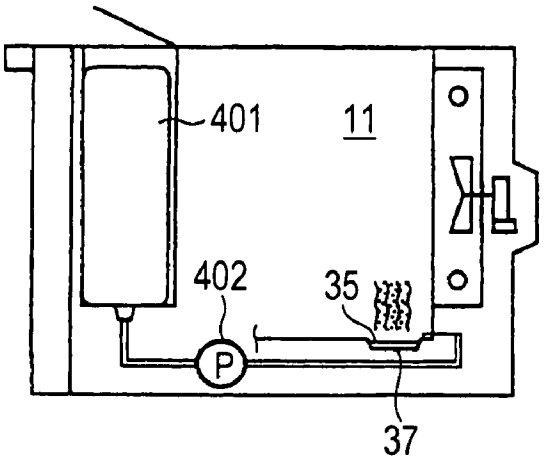
FIGS. 31A, 31B, 31C, 31D, and 31E are explanatory views respectively illustrating various kinds of modifications of the steam generating portion.

Next, a modification of the steam generating system of the steam generating portion 15 is described with reference to FIGS. 31A to 31E. In this figure, reference numeral 11 designates a heating chamber. Reference numerals 401, 402, and 403 denote a cartridge type water tank, a pump, and a draining mechanism, respectively. FIG. 31A shows a system of the most simple type using the aforementioned dish 35 and the evaporating dish heater 37. In the case of using a glass-tube-type far-infrared ray heater as the evaporating dish heater 37, an amount of generated heat is about 10 g/min. Thus, the system comes to be able to generate steam in about 40 seconds. Furthermore, when a halogen heater is used as the evaporating dish heater 37, an amount of generated heat is at the same level as that in the case of using the glass-tube-type far-infrared ray heater. Further, the system comes to be able to generate steam in about 25 seconds. The system of this type has advantages in that the structure thereof is simple, that the cost thereof is low, and that a time taken until the generation of steam is short.

Figure 31B:
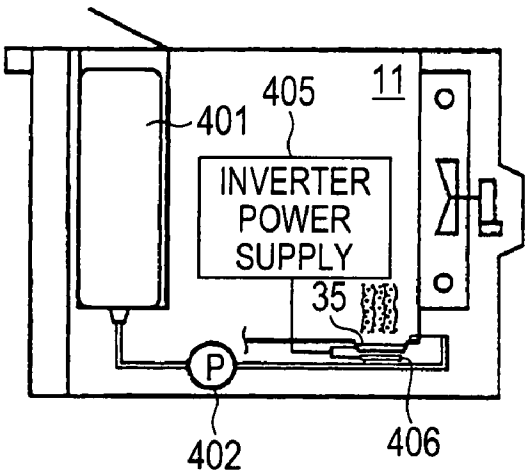

FIG. 31B shows the system of the type adapted to heat water stored in the evaporating dish 35 by using an inverter power supply 405 and an IH (electromagnetic induction heating) coil 406. In the case of the system of this type, an amount of generated heat is about 5 g/min. Further, the system comes to be able to generate steam in about 15 seconds. Thus, the system of this type has an advantage in that a time taken until the generation of steam is short.

Figure 31C:
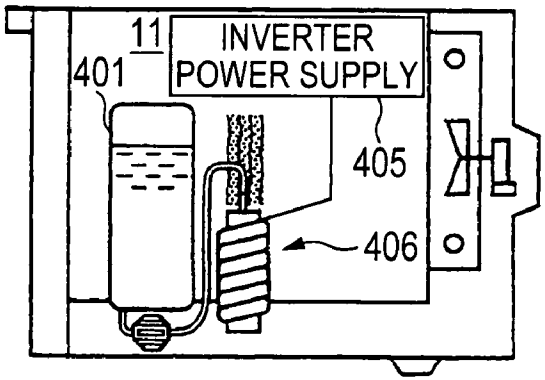

FIG. 31C shows the system of the type using what is called a dropping type IH steamer 406. The system of this type is adapted to generate steam by dropping water droplets onto a member heated by using the inverter power supply 405 and the IH (electromagnetic induction heating) coil 406. Although the system of this type is large in size, an amount of generated heat is about 20 g/min. Further, the system comes to be able to generate steam in about 5 seconds.

Figure 31D:
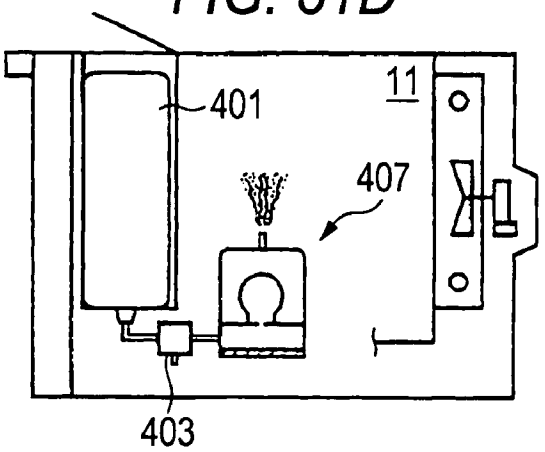

FIG. 31D shows the system of the type adapted to generate steam by using a boiler 407. In the case of the system of this type, an amount of generated heat is about 12 to 13 g/min. Further, the system comes to be able to generate steam in about 40 seconds. Although the structure of the draining mechanism 403 becomes complex, the system can be configured at low cost.

Figure 31E:
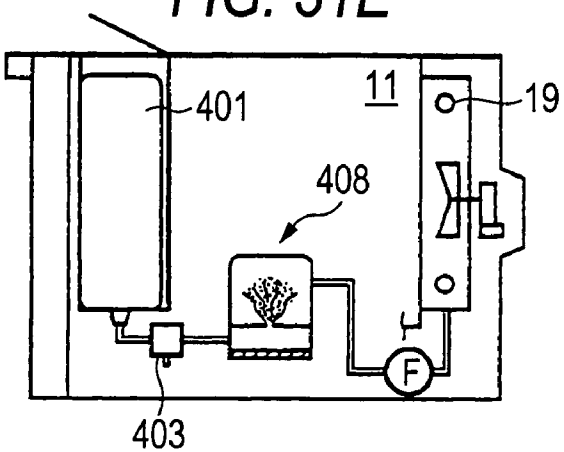

FIG. 31E shows the system of the type adapted to generate steam by using an ultrasonic steam generator 40S. In the system of this type, generated steam is sucked out by a fan F. Subsequently, after the generated steam is heated by a chamber air heater 19, the heated steam is supplied to the heating chamber 11.

EXAMPLES

Hereinafter, examples of various heating processes performed by the aforementioned high-frequency heating apparatus with a steam generating function according to the invention are described.

Figure 32:
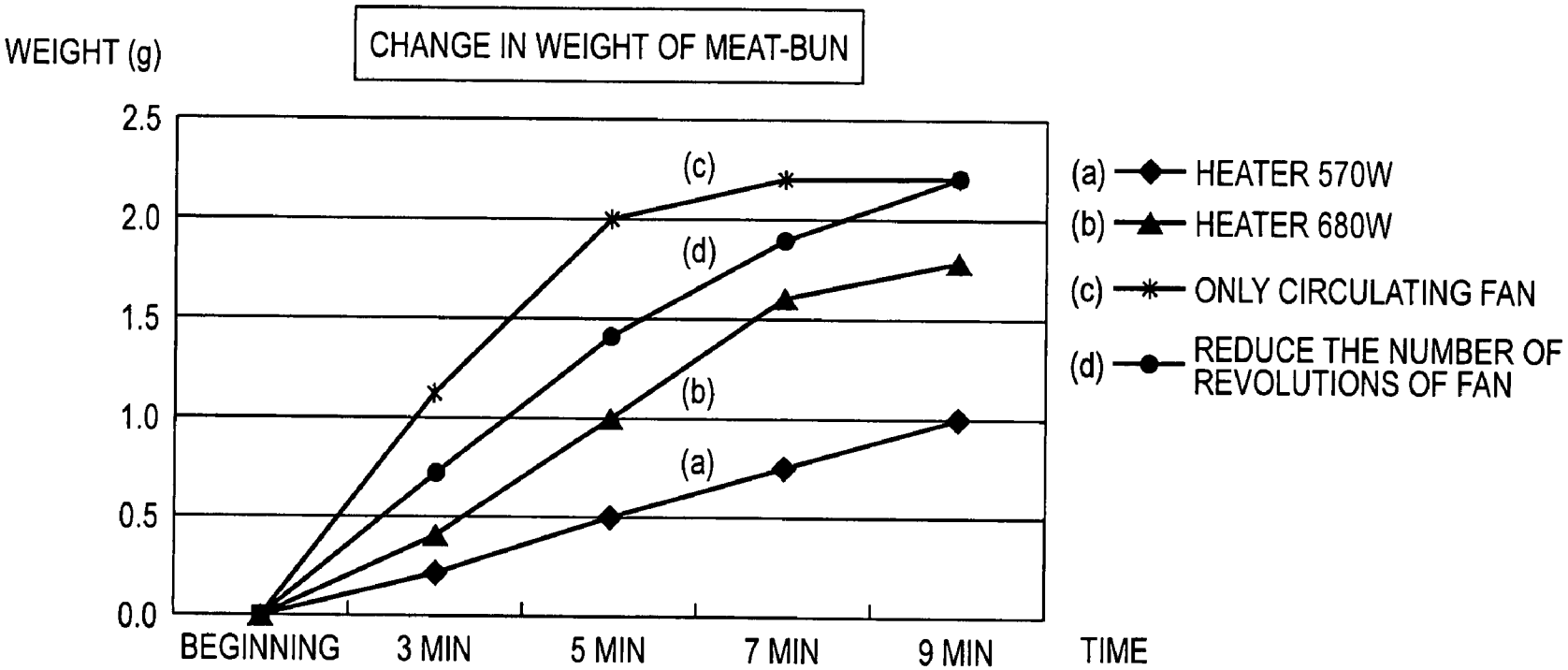
FIG. 32 is a graph illustrating a manner of change in the weight of a single meat-bun when the meat-bun is heated as an object to be heated.

FIG. 32 illustrates a manner of change in the weight of a single meat-bun when the meat-bun was heated as an object to be heated. In the case that the meat-bun was heated by steam (that is, steamed), it can be decided according to increase in amount of water content whether or not the meat-bun was finally brought into a good condition by being heated.

Line A indicates change in the weight of the meat-bun in the case that the meat-bun is steam-heated by heating a convection heater as a chamber air heater at 570 W without operating a circulating fan. Line B indicates change in the weight of the meat-bun in the case that the meat-bun was steam-heated by heating a convection heater as a chamber air heater at 680 W without operating the circulating fan. It is understood from these broken line graphs that in both cases, a rate of an increase in the amount of water content to a heating time was relatively low, and that thus, good effects of steaming were not obtained only by simply filling the heating chamber 11 with steam and heating the convection heater.

Conversely, in the case indicated by Lines C and D, in which the circulating fan is operated, a relatively high amount of water content was obtained. Moreover, good effects of steaming were obtained. Furthermore, it is found that even in the case indicated by Line C, in which the number of revolutions of the circulating fan was reduced, good effects of steaming were obtained when time passed. That is, the amount of water content can be increased by an operation of the circulating fan. Therefore, the circulation of steam is indispensable to the steam heating.

Figure 33:
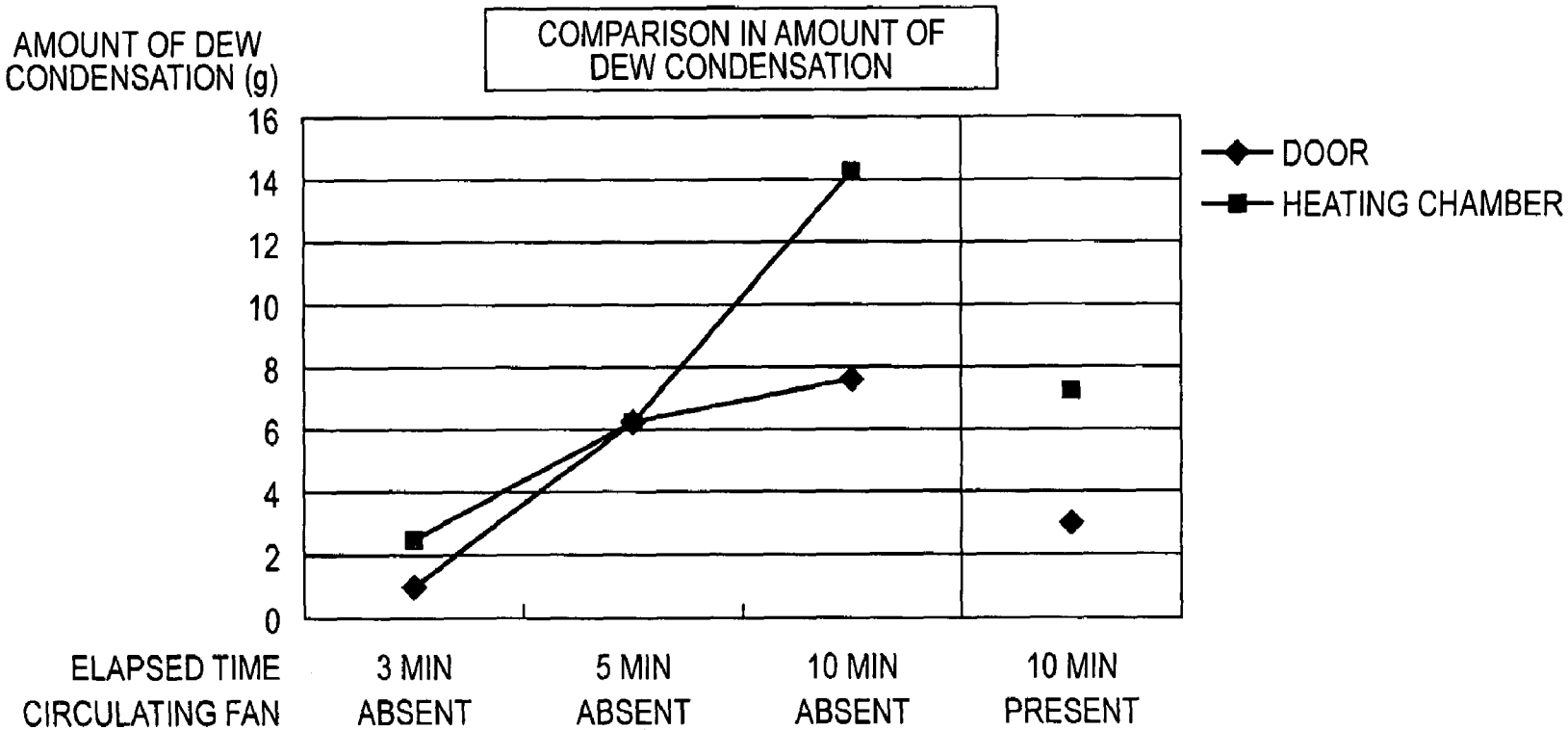
FIG. 33 is a graph illustrating the difference in amounts of dew condensation formed on a door and in a heating chamber between the cases that a circulating fan is operated, and that the circulating fan is not operated.

FIG. 33 illustrates the difference in amounts of dew condensation formed on the door and in the heating chamber between the cases that the circulating fan was operated, and that the circulating fan was not operated. It was found that although the amount of dew condensation increased with the passage of time, the amount of dew condensation could be largely decreased by operating the circulating fan. When 10 minutes passed since the initiation of the heating, the amounts of dew condensation formed on the door and in the heating chamber were 7.6 g and 14.4 g, respectively, in the case that the circulating fan was not rotated. However, in the case that the circulating fan was not rotated, such amounts of dew condensation were decreased to 3.1 g and 7.3 g, respectively. Thus, the amount of dew condensation can be reduced to half.

Figure 34:
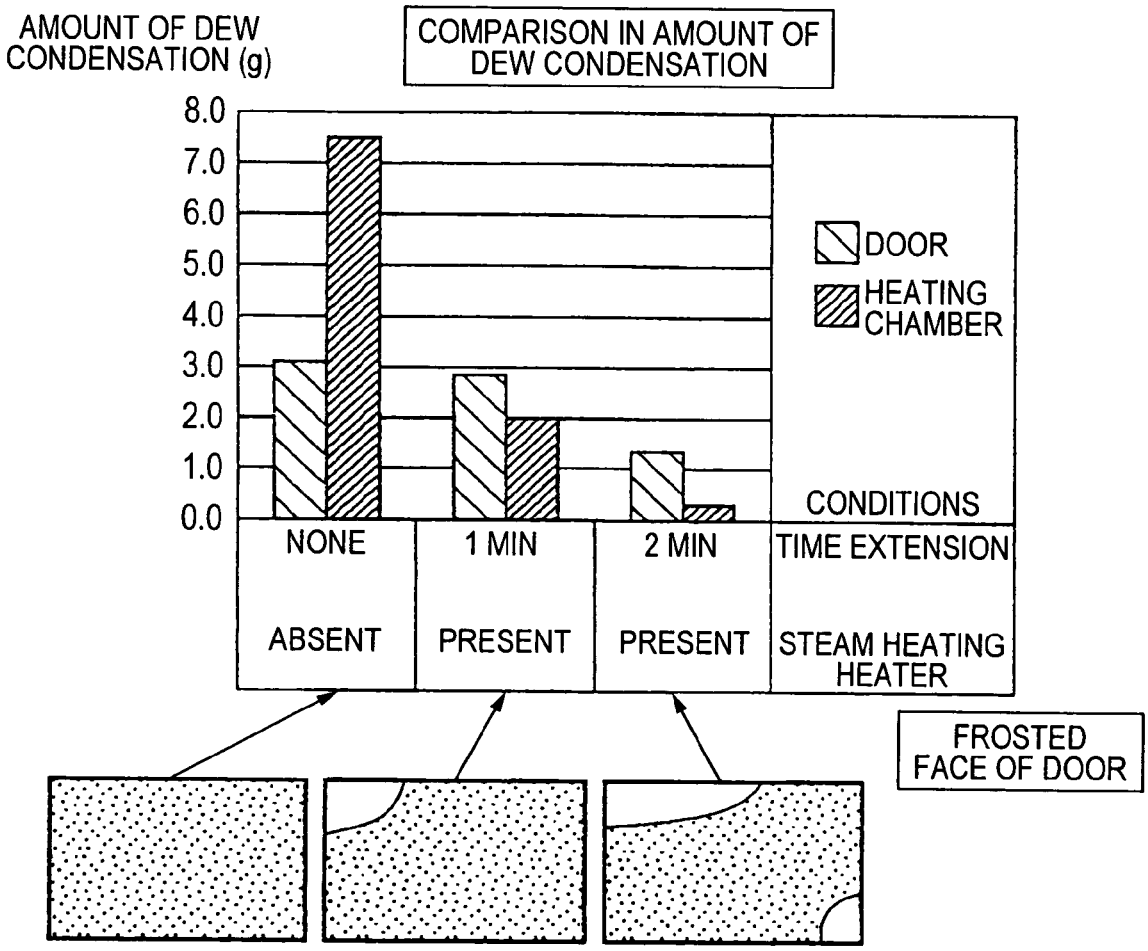
FIG. 34 is a histogram illustrating change in each of the amounts of dew condensation formed in the heating apparatus and on the door, which was checked in each of the cases that heating by using a convection heater was performed, and that the heating by using the convection heater was not performed.

FIG. 34 shows results of checking change in each of the amounts of dew condensation formed in the heating apparatus and on the door in each of the cases that heating by using the convection heater was performed, and that the heating by using the convection heater was not performed. Especially, the amount of dew condensation formed in the heating chamber was considerably decreased from 7.3 g, which was a value of that of dew condensation at the finish of heating, to 3.0 g, which was a value of that of dew condensation when 1 minute passed since then, and to 0.3 g, which was a value of that of dew condensation when 2 minutes passed since the finish of heating, by operating the convection heater. Further, the amount of dew condensation formed on the door was liable to decrease, for instance, from 3.1 g, which was a value of that of dew condensation at the finish of heating, to 2.9 g, which was a value of that of dew condensation when 1 minute passed since then, and to 1.3 g, which was a value of that of dew condensation when 2 minutes passed since the finish of heating, by operating the convection heater.

Figure 35:
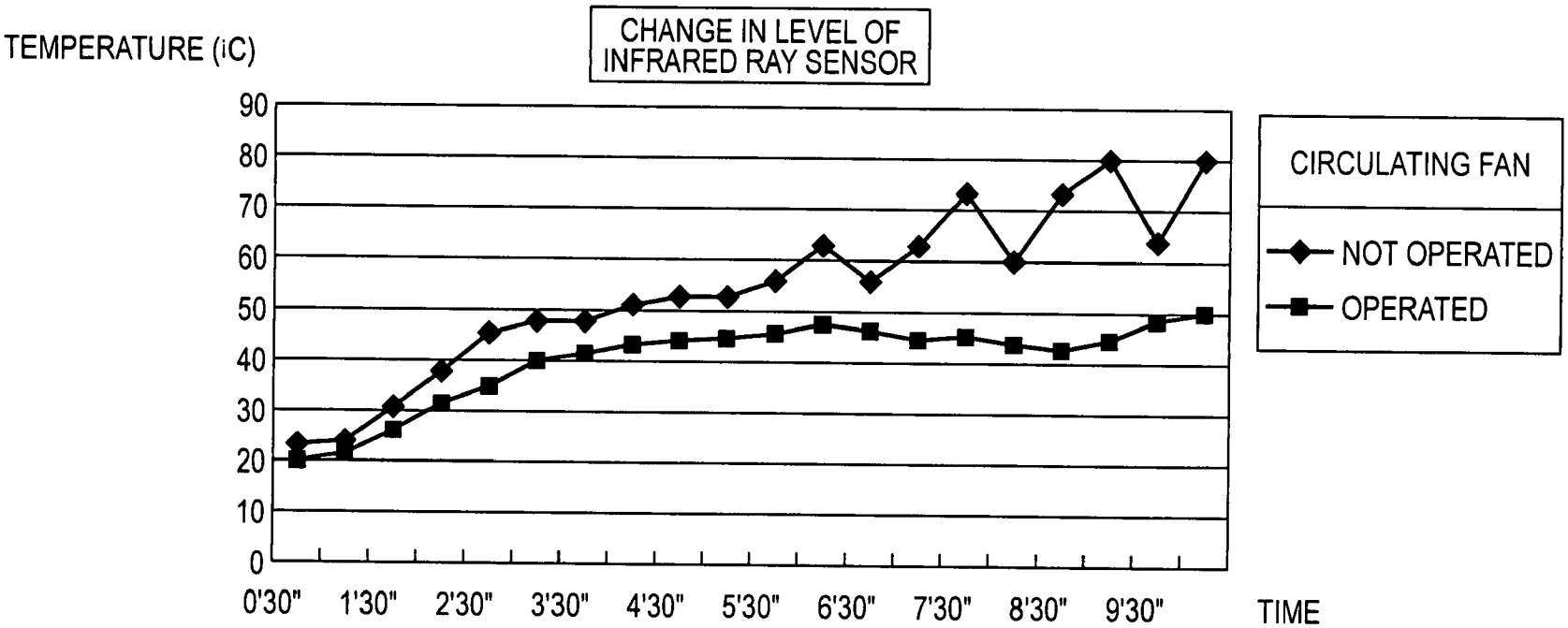
FIG. 35 is a graph illustrating results of checking the performance of an infrared ray sensor in each of the cases that the circulating fan was operated during the heating chamber was filled with steam, and that the circulating fan was not operated during the heating chamber was filled with steam.

FIG. 35 is a graph illustrating results of checking the performance of the infrared ray sensor in each of the cases that the circulating fan was operated during the heating chamber was filled with steam, and that the circulating fan was not operated during the heating chamber was filled with steam. In the case that the circulating fan was not operated, a fluctuation occurred in values measured by the infrared ray sensor halfway in the measurement, so that the accuracy of the measurement was degraded. Conversely, in the case that the circulating fan was operated, stable measurements could be conducted at all times. That is, the detection level of the infrared ray sensor can be stabilized by operating the circulating fan. Consequently, the measurement of the temperature can be performed in good conditions.

INDUSTRIAL APPLICABILITY

According to the high-frequency heating apparatus with a steam generating function, steam is generated in the heating chamber. Thus, steam can be quickly supplied into the heating chamber. Further, the efficiency in generating steam can be enhanced. Moreover, because of the presence of the steam generating portion in the heating chamber, the cleaning of the steam generating portion can be performed by being simplified, simultaneously with the cleaning of the inside of the heating chamber. The internal environment of the heating chamber can be maintained in a sanitary condition. Furthermore, the heating apparatus is adapted so that air in the heating chamber is circulated and agitated by the circulating fan. Thus, especially when the steam heating is performed, steam can be uniformly circulated all around the heating chamber. Consequently, the heating efficiency in heating the object can be enhanced. Further, both the high frequency heating and the steam heating can be concurrently performed as the heating method. Alternatively, one of the high frequency heating and the steam heating can be individually performed. Alternatively, both the high frequency heating and the steam heating can be performed in a predetermined order. These ways of performing the heating method can be freely chosen and performed. Thus, an appropriate cooking method can be selected according to the kind of food, and to which of a frozen food and a chilled food the object is. Especially, in the case of employing both the high frequency heating and the steam heating, the rate of rise of temperature can be increased. Thus, quick and efficient cooking is enabled.

Further, the high-frequency heating apparatus of the invention with a steam generating function is adapted so that air circulating in the heating chamber is heated by the chamber air heater. Thus, the temperature of steam can be freely raised. Efficient rise of the temperature of the object is realized owing to the overheated steam by raising the temperature of the steam. Moreover, the rise of the temperature of the steam enables the high-temperature steam to brown the object. Furthermore, when the object is a frozen food, the defrosting of the object can be more efficiently performed.

The invention claimed is:

1. A high-frequency heating apparatus with a steam generating function, which heat-treats an object by supplying at least high-frequency waves or steam to a heating chamber that accommodates said object, comprising:

a high frequency wave generating portion;

a steam generating portion for generating steam in said heating chamber, wherein said steam generating portion includes an evaporating dish that has a water storing recess adapted to generate steam by heating, and wherein said evaporating dish has tapered portions respectively provided at both end portions thereof so that said water storing recess gradually becomes shallower along a longitudinal direction thereof in each of said tapered portions;

a circulating fan for agitating air in said heating chamber;

wherein said steam generating portion has an evaporating dish heater for heating said evaporating dish; and an electromagnetic wave stirring portion for stirring high frequency waves sent from said high frequency wave generating portion and for supplying the high frequency waves to said evaporating dish.

2. The high-frequency heating apparatus according to claim 1, which further comprises a chamber air heater for heating air that circulates in said heating chamber.

3. The high-frequency heating apparatus according to claim 1, wherein said heating chamber is partitioned from circulating fan chamber, in which said circulating fan is disposed, through a partition plate, and wherein at least one ventilation hole for enabling said heating chamber and said circulating fan chamber to communicate with each other is formed in said partition plate.

4. The high-frequency heating apparatus according to claim 1, said evaporating dish has a cover, which covers the top face of said evaporating dish and which has at least one aperture that opens a part of the top face thereof, and wherein said heating chamber is partitioned from circulating fan chamber, in which said circulating fan is disposed, through a partition plate, wherein a ventilation hole for enabling said heating chamber and said circulating fan chamber to communicate with each other is formed in said partition plate, and wherein said aperture is disposed under one ventilation hole for intaking air from said heating chamber to said circulating fan chamber, among said ventilation holes formed in said partition plate.

5. The high-frequency heating apparatus according to claim 3 or 4, wherein a ventilation hole for blasting air from said circulating fan to said heating chamber is provided at least in a lower half portion of said partition plate, and wherein air in said heating chamber is circulated upwardly by said circulating fan.

6. The high-frequency heating apparatus according to claim 3 or 4, wherein a self-cooled fan chamber partitioned from said heating chamber and said circulating fan chamber is provided in addition thereto, wherein an infrared ray sensor for detecting a temperature in said heating chamber through a detection hole provided in the wall surface of said heating chamber, and a self-cooled fan concentrically, provided with a drive shaft of said circulating fan, for cooling a drive motor are accommodated in said self-cooled fan chamber, and wherein a pressure in a self-cooled fan chamber in the vicinity of the detection hole is maintained by rotation of said self-cooled fan at a value that is higher than a value of a pressure in said heating chamber.

7. A high-frequency heating apparatus with a steam generating function, which heat-treats an object by supplying at least high-frequency waves or steam to a heating chamber that accommodates said object, comprising:

a high frequency wave generating portion;

a steam generating portion, provided in said heating chamber, for generating steam from an evaporating dish that has a water storing recess adapted to generate steam by being heated, wherein said evaporating dish has tapered portions respectively provided at both end portions thereof so that said water storing recess gradually becomes shallower along a longitudinal direction thereof in each of said tapered portions, wherein said steam generating portion has an evaporating dish heater for heating said evaporating dish; and an electromagnetic wave stirring portion for stirring high frequency waves sent from said high frequency wave generating portion and for supplying the high frequency waves to said evaporating dish.

8. The high-frequency heating apparatus according to claim 1 or 7, wherein said evaporating dish is disposed on a back-side bottom face, which is on the opposite side of an object outlet of said heating chamber, from which the object is taken out.

9. The high-frequency heating apparatus according to claim 1 or 7, wherein said evaporating dish is disposed on a bottom face along one of side wall surfaces of said heating chamber.

10. The high-frequency heating apparatus claim 1 or 7, wherein said evaporating dish is disposed at a place at which a top face of said evaporating dish is at a predetermined height above a bottom face of said heating chamber.

11. The high-frequency heating apparatus according to claim 1 or 7, further comprising an infrared ray sensor for measuring a temperature in said heating chamber, and wherein said evaporating dish is disposed at a place that is substantially outside a temperature measurement area in which said sensor measures the temperature.

12. The high-frequency heating apparatus according to claim 1 or 7, wherein said evaporating dish is disposed in such a manner as to be detachable from said heating chamber.

13. The high-frequency heating apparatus according to claim 1 or 7, wherein said evaporating dish has a cover, which covers the top face of said evaporating dish and which has at least one aperture that opens a part of the top face thereof.

14. The high-frequency heating apparatus according to claim 13, wherein said cover is disposed in such a manner as to be able to be detached from said evaporating dish.

15. The high-frequency heating apparatus according to claim 13, wherein a leg portion for forming a gap having a predetermined height to said evaporating dish therefrom is provided on a bottom surface of said cover.

16. The high-frequency heating apparatus according to claim 13, wherein a plurality of said apertures are provided in such a way as to extend along a longitudinal direction of said cover.

17. The high-frequency heating apparatus according to claim 13, wherein said cover is made of a low-dielectric-constant material.

18. The high-frequency heating apparatus according to claim 1 or 7, wherein said steam generating portion has a reflector for reflecting radiation heat, which is radiated from said evaporating dish heater, to said evaporating dish.

19. The high-frequency heating apparatus according to claim 1 or 7, which further comprises an electromagnetic wave stirring portion for stirring high frequency waves sent from said high frequency wave generating portion and for supplying the high frequency waves to said evaporating dish.

20. The high-frequency heating apparatus according to claim 1 or 7, which further comprises a water supply portion for supplying water to said steam generating portion.

21. The high-frequency heating apparatus according to claim 20, wherein said water supply portion comprises a water storage tank and a water conveyance pump for supplying a predetermined amount of water to said evaporating dish through a water supply conduit.

22. The high-frequency heating apparatus according to claim 21, wherein said water supply portion has a nozzle, detachably provided at a water supply conduit end portion disposed on a wall surface of said heating chamber, for supplying water to said evaporating dish.

23. The high-frequency heating apparatus according to claim 22, wherein said nozzle is formed from a heat resistance resin material.

24. The high-frequency heating apparatus with a steam generating function according to claim 1 or 7, wherein a supply opening for blowing outside-air to an inner surface of a translucent window of an opening/closing door is provided in a side wall in the vicinity of said opening/closing door of said heating chamber.

25. The high-frequency heating apparatus with a steam generating function according to claim 24, wherein said supply opening is provided in an upper part of one of side wall faces of said heating chamber, and wherein an exhaust outlet for exhausting air of said heating chamber is provided in a lower part of the other side wall surface of said heating chamber.

* * * * *